US010890069B2

(12) United States Patent
Maust et al.

(10) Patent No.: US 10,890,069 B2
(45) Date of Patent: Jan. 12, 2021

(54) REFUGE SHELTER, COUPLER AND METHOD

(71) Applicants: David Emerson Maust, Grantsville, MD (US); Shawn L. Fike, Oakland, MD (US); Michael Scott Bishoff, Friendsville, MD (US)

(72) Inventors: David Emerson Maust, Grantsville, MD (US); Shawn L. Fike, Oakland, MD (US); Michael Scott Bishoff, Friendsville, MD (US)

(73) Assignee: STRATA PRODUCTS WORLDWIDE, LLC, Sandy Springs, GA (US)

( * ) Notice: Subject to any disclaimer, the term of this patent is extended or adjusted under 35 U.S.C. 154(b) by 0 days.

(21) Appl. No.: 14/242,502

(22) Filed: Apr. 1, 2014

(65) Prior Publication Data

US 2014/0300174 A1 Oct. 9, 2014

Related U.S. Application Data

(60) Provisional application No. 61/808,115, filed on Apr. 3, 2013.

(51) Int. Cl.
*E21F 11/00* (2006.01)
*E04H 15/20* (2006.01)

(52) U.S. Cl.
CPC ..... *E21F 11/00* (2013.01); *E04H 15/20* (2013.01); *E04H 2015/201* (2013.01); *E04H 2015/206* (2013.01)

(58) Field of Classification Search
CPC ..... E21F 11/00
See application file for complete search history.

(56) References Cited

U.S. PATENT DOCUMENTS

| | | | | |
|---|---|---|---|---|
| 3,261,659 | A | 7/1966 | Schwichtenberg et al. | |
| 3,393,479 | A | 7/1968 | Stotnick | |
| 4,096,702 | A | 6/1978 | Burton | |
| 4,165,738 | A * | 8/1979 | Graves et al. | 128/202.13 |
| 4,815,363 | A * | 3/1989 | Harvey | 454/168 |
| 5,331,991 | A | 7/1994 | Nilsson | |

(Continued)

FOREIGN PATENT DOCUMENTS

| | | | |
|---|---|---|---|
| GB | 515442 | A | 12/1939 |
| GB | 2043737 | A | 10/1980 |

(Continued)

*Primary Examiner* — Janine M Kreck
(74) *Attorney, Agent, or Firm* — Ansel M. Schwartz

(57) ABSTRACT

A refuge shelter includes a container. The shelter includes a tent that is disposed in the container in an undeployed state. The tent includes an inflatable support structure which is inflatable from an undeployed state in the container to a deployed state, and a seal which seals the tent to the container in a deployed state. The support structure has a plurality of hoses interconnected by couplers. The hoses have an inside diameter of less than 5 inches. A gas flow apparatus. A refuge shelter for miners in a mine includes a container and a tent that is disposed in the container. The tent has a test support to which a sample of the external environment can be obtained from inside the tent when the tent is deployed. A method for providing a refuge chamber for miners in a mine.

1 Claim, 33 Drawing Sheets

(56) References Cited

U.S. PATENT DOCUMENTS

| | | | | |
|---|---|---|---|---|
| 5,398,676 | A | 3/1995 | Press et al. | |
| 5,411,046 | A | 5/1995 | Wan | |
| 5,537,784 | A * | 7/1996 | Baldwin | 52/2.17 |
| 5,601,317 | A * | 2/1997 | Crouse et al. | 285/242 |
| 5,630,296 | A | 5/1997 | Kendall | |
| 5,706,846 | A | 1/1998 | Sutton | |
| 5,727,353 | A | 3/1998 | Getz et al. | |
| 5,862,819 | A | 1/1999 | Cradeur | |
| 6,179,367 | B1 * | 1/2001 | Bowen | E04H 15/06 135/124 |
| 6,192,633 | B1 * | 2/2001 | Hilbert | E04H 1/1277 52/2.18 |
| 6,708,451 | B1 | 3/2004 | Gomes | |
| 7,198,045 | B2 | 4/2007 | Risley et al. | |
| 7,695,049 | B2 | 4/2010 | Colborne | |
| 2002/0083653 | A1 | 7/2002 | Hilbert | |
| 2006/0055193 | A1 | 3/2006 | Colborne | |
| 2007/0137113 | A1 * | 6/2007 | Turcot | E04H 15/20 52/2.18 |
| 2007/0199244 | A1 | 8/2007 | Kennedy | |
| 2007/0202796 | A1 | 8/2007 | Kennedy et al. | |
| 2008/0106137 | A1 * | 5/2008 | Paton-Ash et al. | 299/12 |
| 2008/0313969 | A1 | 12/2008 | Colucci et al. | |
| 2010/0044369 | A1 * | 2/2010 | Toepfer et al. | 220/1.5 |
| 2013/0153060 | A1 * | 6/2013 | Barrett | 137/551 |
| 2013/0199423 | A1 * | 8/2013 | MacCallum et al. | 109/1 S |
| 2014/0076324 | A1 * | 3/2014 | Han et al. | 128/205.26 |

FOREIGN PATENT DOCUMENTS

| | | | |
|---|---|---|---|
| WO | WO 2005/052319 | A1 | 6/2005 |
| WO | WO 2005/086613 | A2 | 9/2005 |

* cited by examiner

REFUGE SHELTER, COUPLER AND METHOD

CROSS-REFERENCE TO RELATED APPLICATIONS

This is a non-provisional of U.S. provisional application Ser. No. 61/808,115 filed Apr. 3, 2013, incorporated by reference herein.

FIELD OF THE INVENTION

The present invention is related to refuge shelters which are portable and deployable through air inflation. More specifically, the present invention is related to refuge shelters which are portable and deployable through air inflation which have a support structure made of fire hose having an inside diameter of less than 4 inches.

BACKGROUND OF THE INVENTION

Refuge shelters which are portable and deployable through air inflation in the past have had leakage problems. Tents, which expand from the metal container to which they are attached, have in the past used an inflatable air structure that was susceptible to air leaks which limited the inflatable structure to maintain its integrity over long periods of time, such as 96 hours as was typically expected and required of them. If a leakage problem was present, then the inflatable air structure might have to be re-inflated or possibly even have patches applied to it so it could maintain its integrity for long periods of time. Given that an emergency situation is the basis of having to deploy the tents, any such repair or leakage issues would be difficult to deal with due to the possibly dangerous environment outside of the deployed refuge shelter against which the refuse shelter protected.

Furthermore, the inflatable air structure that supported the deployed tent in the past was rather large and cumbersome and took up a relevant amount of interior space that could otherwise be used for the miners or other type of individuals who sought protection inside the deployed refuge shelter. There is thus a need for a deployable refuge shelter that has a support structure which is inflated and which has essentially no leaks and takes up little or a negligible amount of interior space inside the deployed tent 14 of the refuge shelter.

BRIEF SUMMARY OF THE INVENTION

The present invention pertains to a refuge shelter. The shelter may be for miners in a mine, or may be for individuals or may be subject to a hazardous environment, whether it be above ground or below ground. The shelter comprises a container. The shelter comprises a tent that is disposed in the container in an undeployed state which is expandable to a deployed state and extends from the container to provide a protected atmosphere for the miners, the container accessible from inside the tent. The tent includes an inflatable support structure which is inflatable from an undeployed state to a deployed state, and a seal which seals the tent to the container in a deployed state. The support structure is having a plurality of hoses interconnected by couplers. The hoses have an inside diameter of less than 5 inches. The container includes a bank of compressed gas bottles that are operable to inflate the support structure thereby expanding the tent to the deployed state.

The present invention pertains to a gas flow apparatus. The apparatus comprises a housing having at least three distinct barbed fittings, including a first, a second and a third barbed fitting. The apparatus comprises a first fireman hose having an end disposed over the first barbed fitting. The apparatus comprises a second fireman hose having an end disposed over the second barbed fitting. The apparatus comprises a third fireman hose having an end disposed over the third barbed fitting. The apparatus comprises a first clamp which fits over the first fireman hose end and the first fitting to clamp the first fireman hose to the first fitting. The apparatus comprises a second clamp which fits over the second fireman hose end and the second fitting to clamp the second fireman hose to the second fitting. The apparatus comprises a third clamp which fits over the third fireman hose end and the third fitting to clamp the third fireman hose to the third fitting.

The present invention pertains to a refuge shelter for miners in a mine to protect the miners from the external environment. The shelter comprises a container. The shelter comprises a tent that is disposed in the container in an undeployed state which is expandable to a deployed state and extends from the container to provide a protected atmosphere for the miners. The container is accessible from inside the tent. The tent has a test support to which a sample of the external environment can be obtained from inside the tent.

The present invention pertains to a method for providing a refuge shelter for miners in a mine. The method comprises the steps of opening a container made of metal. There is the step of expanding a tent that is disposed in the container in an undeployed state to a deployed state that extends from the container to provide a protected atmosphere for the miners. The container is accessible from inside the tent. The tent includes an inflatable support structure which is inflatable from an undeployed state to a deployed state, and a seal which seals the tent to the container in a deployed state, the support structure having a plurality of hoses interconnected by couplers. The hoses have an inside diameter of less than 5 inches. The container includes a bank of compressed gas bottles that are operable to inflate the support structure thereby expanding the tent to the deployed state.

BRIEF DESCRIPTION OF THE SEVERAL VIEWS OF THE DRAWING

In the accompanying drawings, the preferred embodiment of the invention and preferred methods of practicing the invention are illustrated in which:

FIG. 39 B shows an end of the hose of FIG. 39.

DETAILED DESCRIPTION OF THE INVENTION

Figure 1:
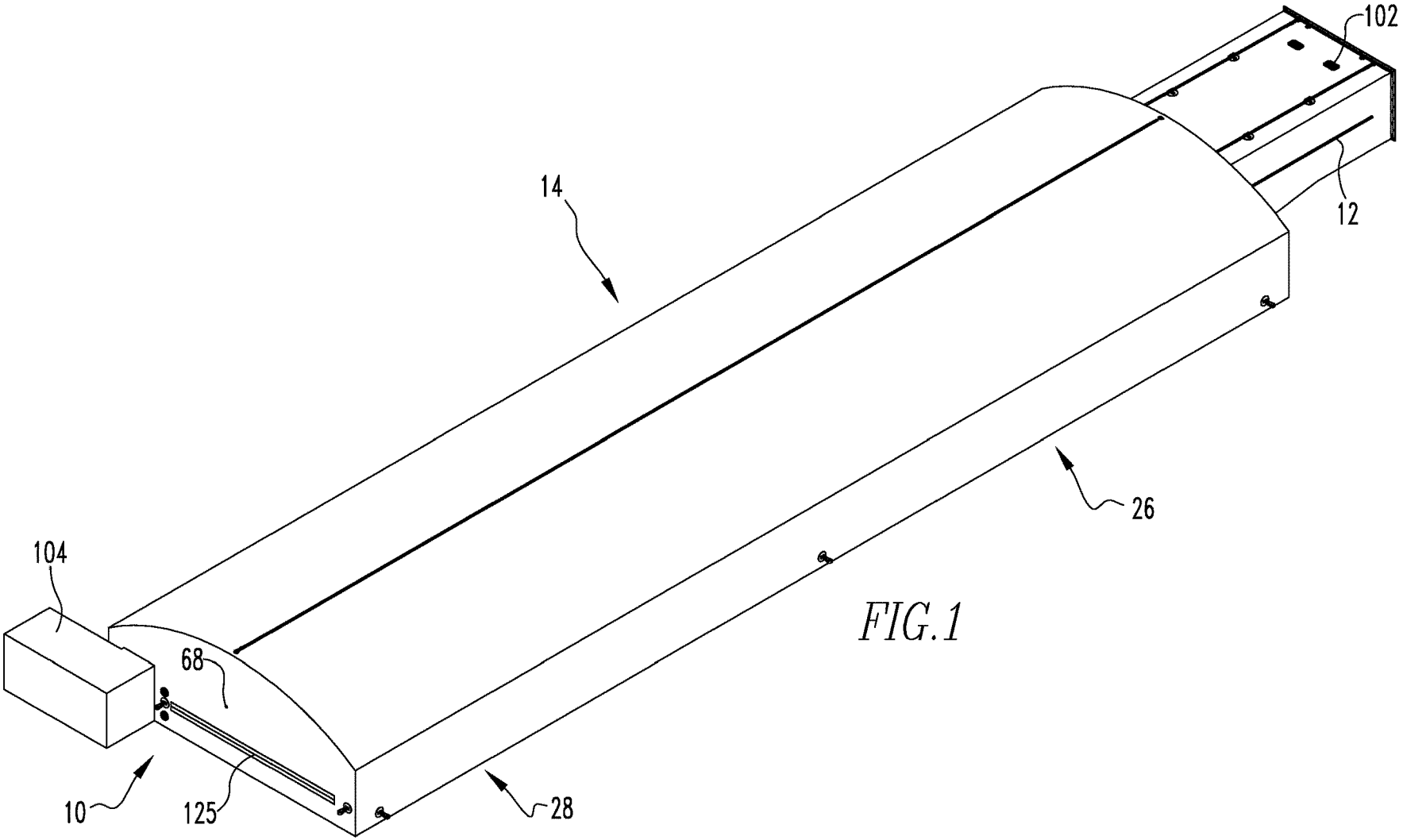
FIG. 1 is a perspective view of the refuge shelter in a deployed state of the present invention.
Figure 2:
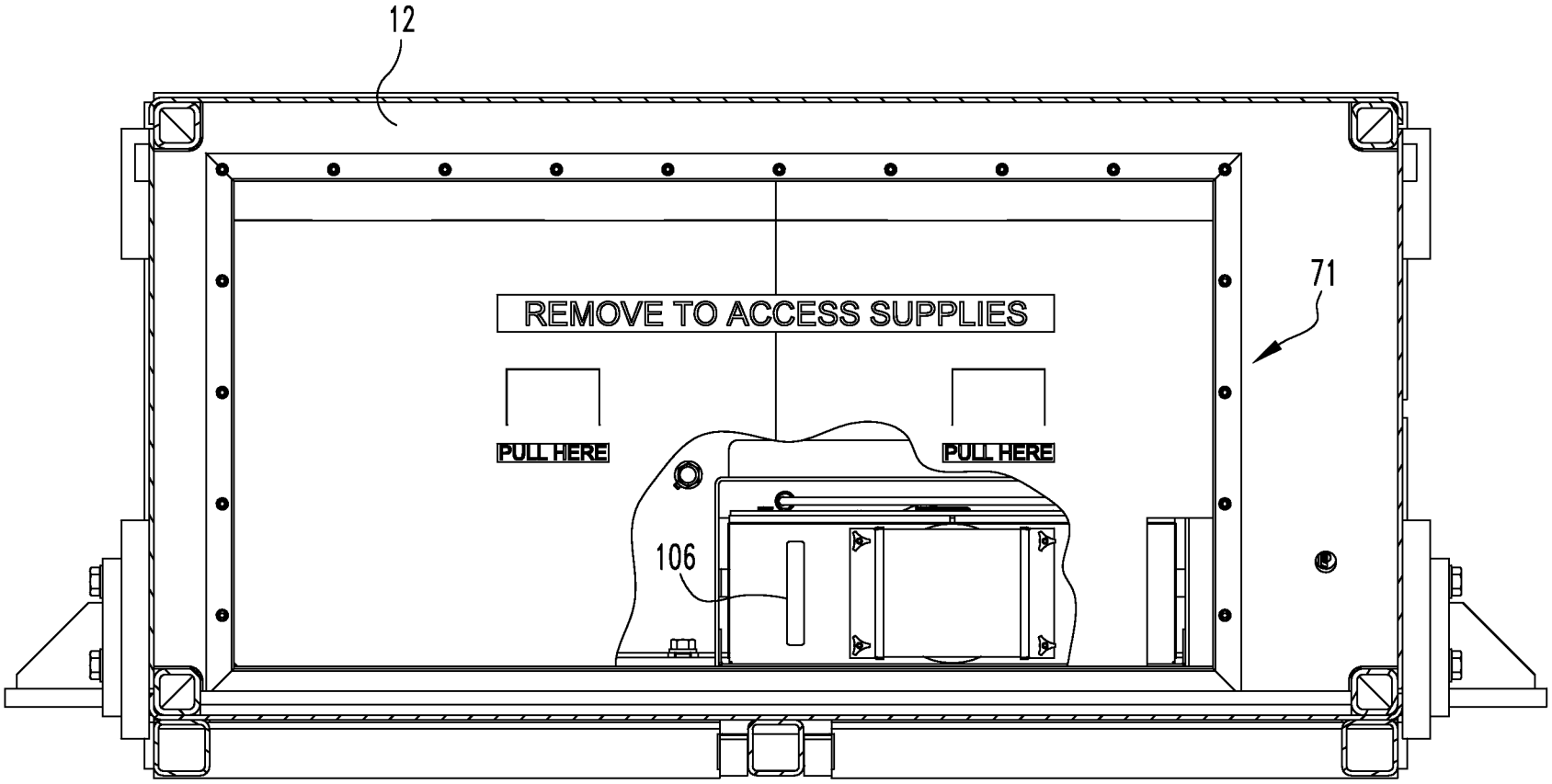
FIG. 2 is a cutaway view of the container as seen from inside the deployed tent.
Figure 3:
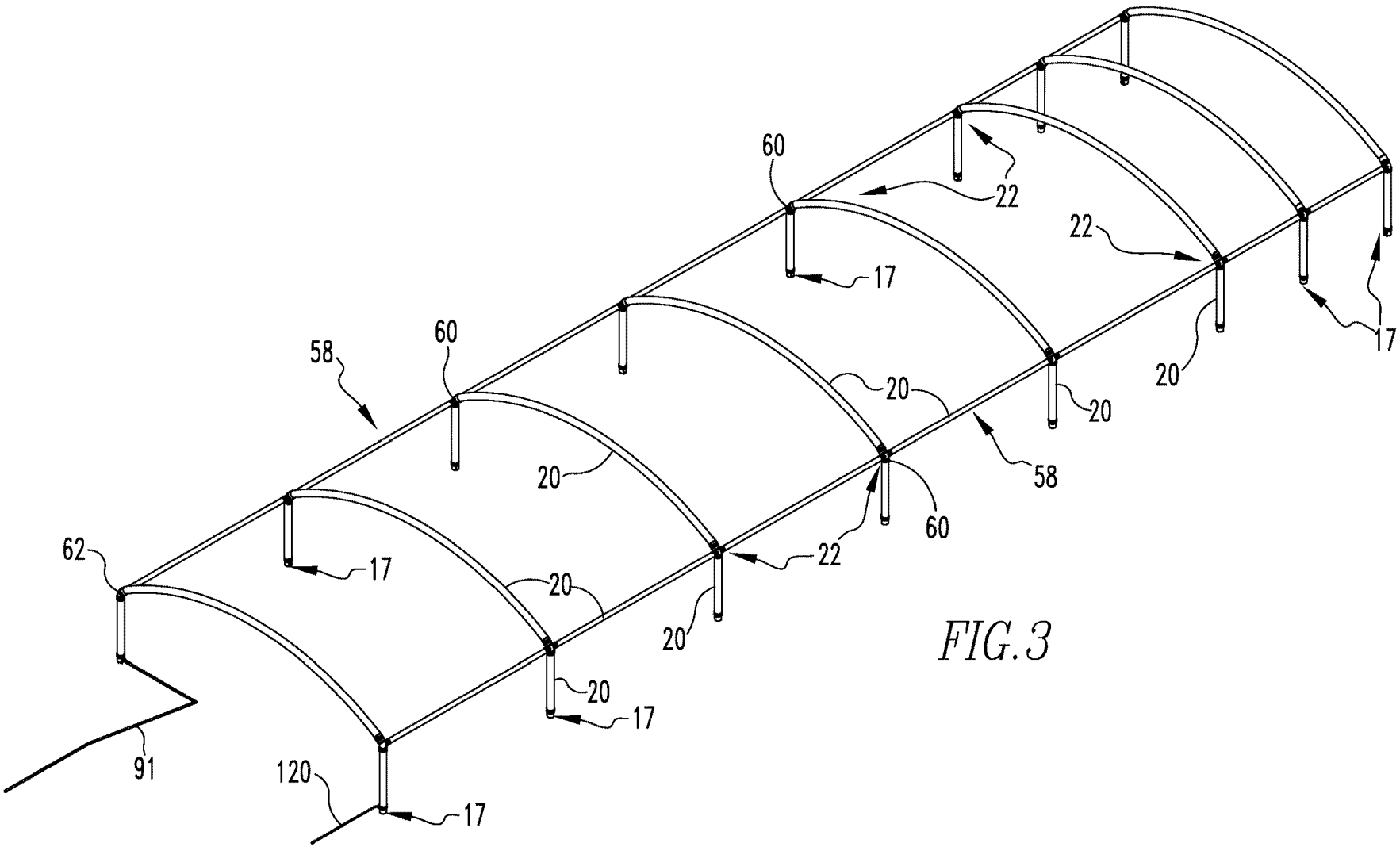
FIG. 3 is a perspective view of the support structure.
Figure 4:
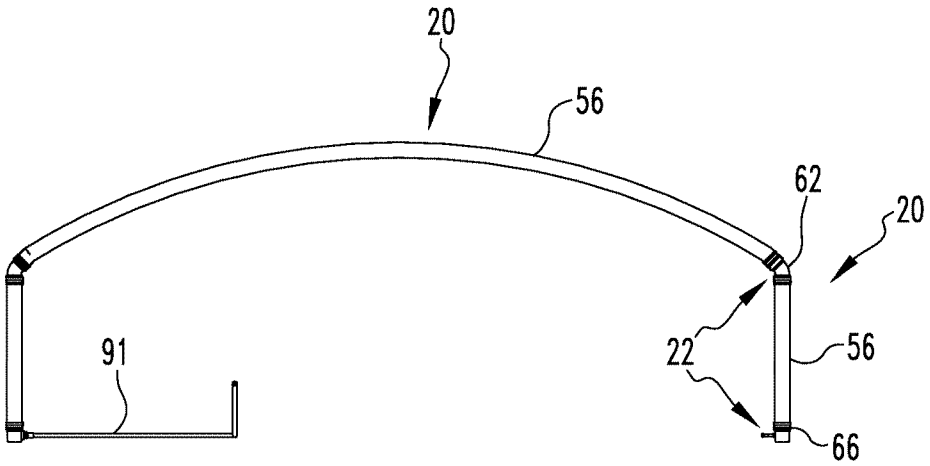
FIG. 4 is a front view of the support structure.
Figure 5:
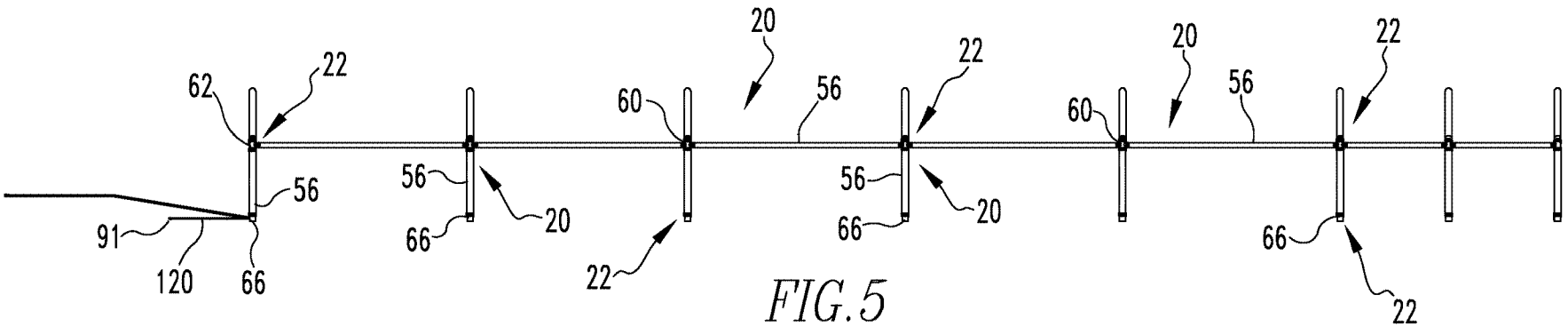
FIG. 5 is a side view of the support structure.
Figure 6:
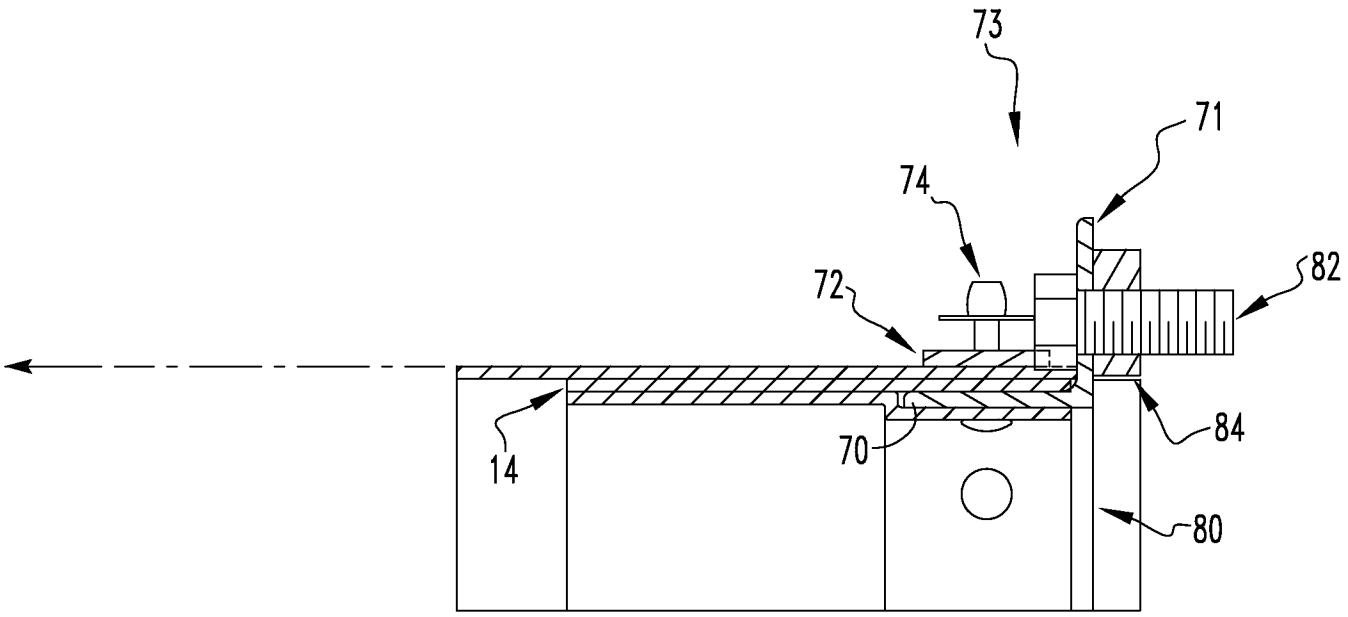
FIG. 6 is a cutaway view of the seal between the tent and the container.
Figure 7A:
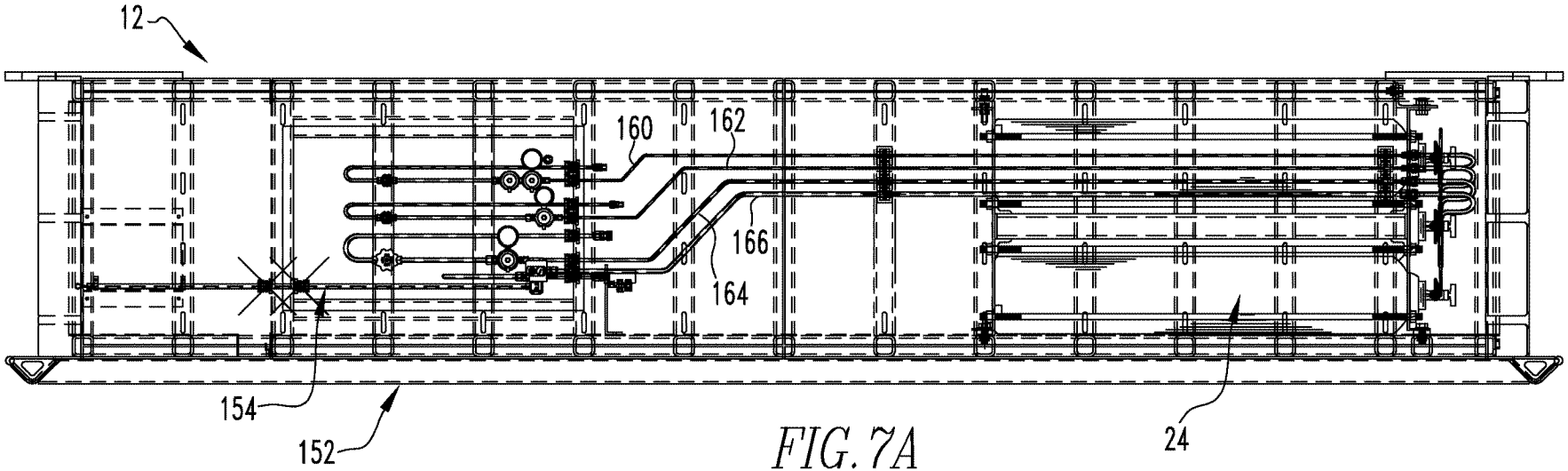
FIG. 7*a* is a side cutaway view with respect to the trunk lines of the trunks in the container.
Figure 7B:
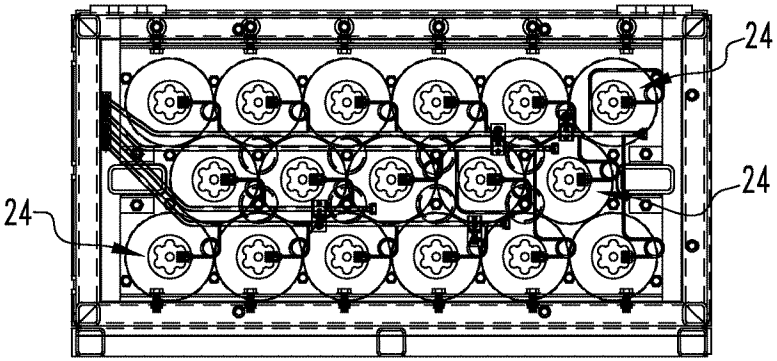
FIG. 7*b* is a cutaway side view of the pressurized gas bottles in the container.

Referring now to the drawings wherein like reference numerals refer to similar or identical parts throughout the several views, and more specifically to FIG. 1 thereof, there is shown a refuge shelter 10. The shelter 10 may be for miners in a mine, or may be for individuals or may be subject to a hazardous environment, whether it be above ground or below ground. The shelter 10 comprises a container 12. The shelter 10 comprises a tent 14 that is disposed in the container 12 in an undeployed state which is expandable to a deployed state and extends from the container 12 to provide a protected atmosphere for the miners. The container 12 is accessible from inside the tent 14, as shown in FIG. 2. The tent 14 includes an inflatable support structure 16, as shown in FIGS. 3-5, which is inflatable from an undeployed state to a deployed state and a seal 18 which seals the tent 14 to the container 12 in a deployed state, as shown in FIG. 6. The support structure 16 has a plurality of hoses 20 interconnected by couplers 22. The hoses 20 have an inside diameter of less than 5 inches. The container 12 includes a bank of compressed gas bottles 24, as shown in FIGS. 7*a* and 7*b* that are operable to inflate the support structure 16 thereby expanding the tent 14 to the deployed state.

Figure 18:
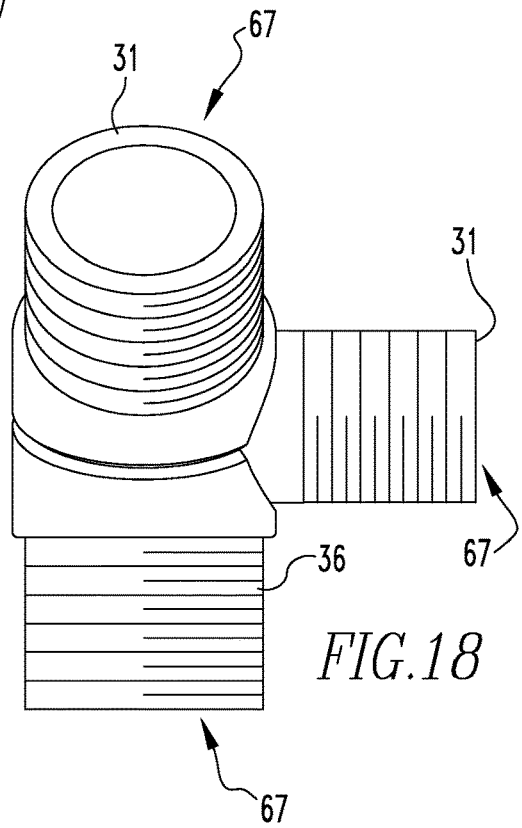
FIG. 18 is a front view of a 3 port coupler.
Figure 19:
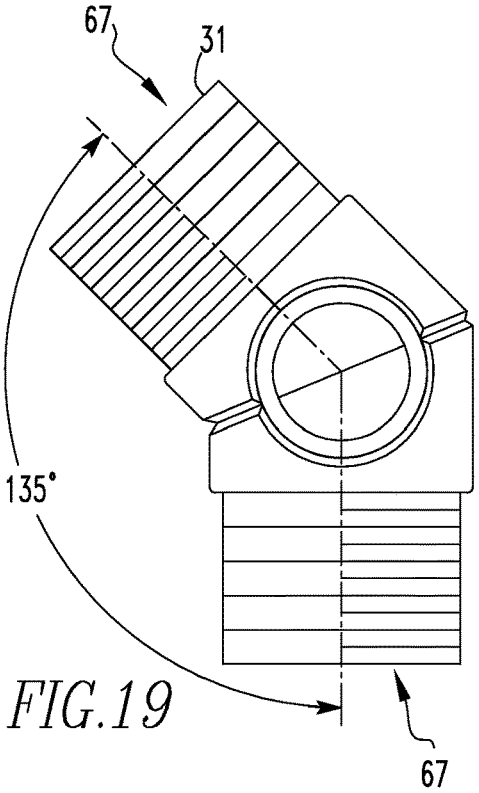
FIG. 19 is a side view of a 3 port coupler.
Figure 20:
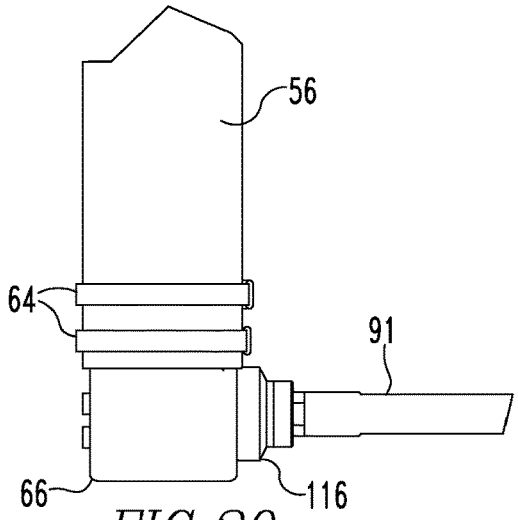
FIG. 20 shows an end coupler.
Figure 21:
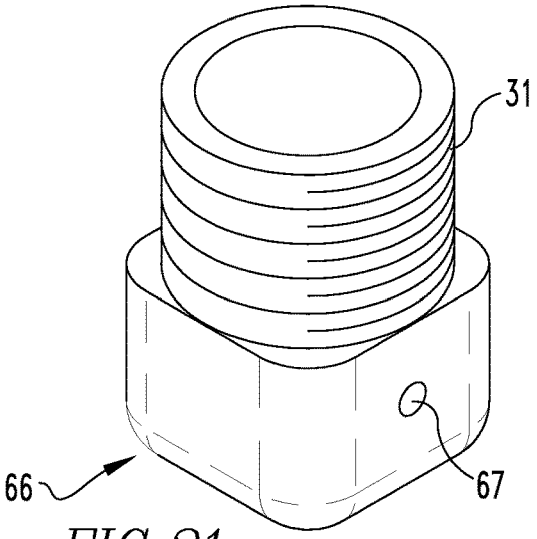
FIG. 21 is a perspective view of an end coupler.
Figure 22:
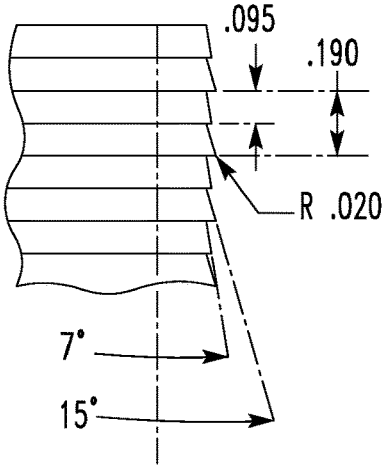
FIG. 22 shows the threading of a barbed fitting.
Figure 25:
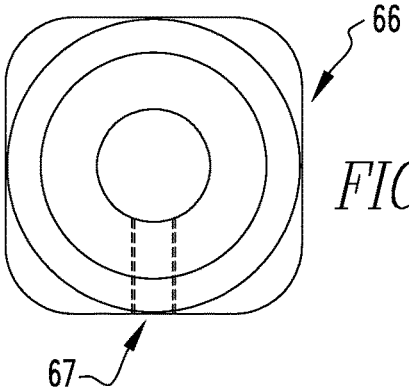
FIG. 25 is an overhead view of an end coupler.
Figure 23:
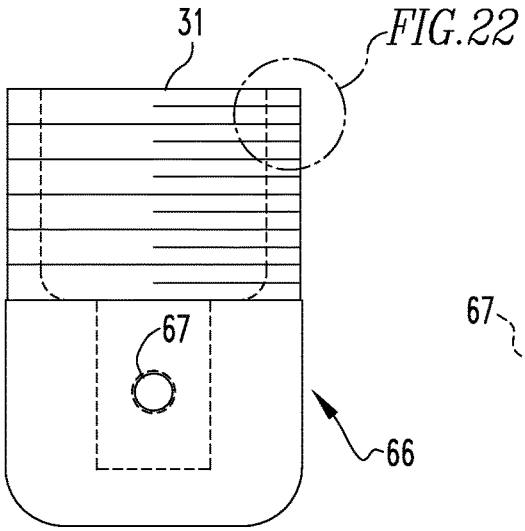
FIG. 23 is a front view of an end coupler.
Figure 24:
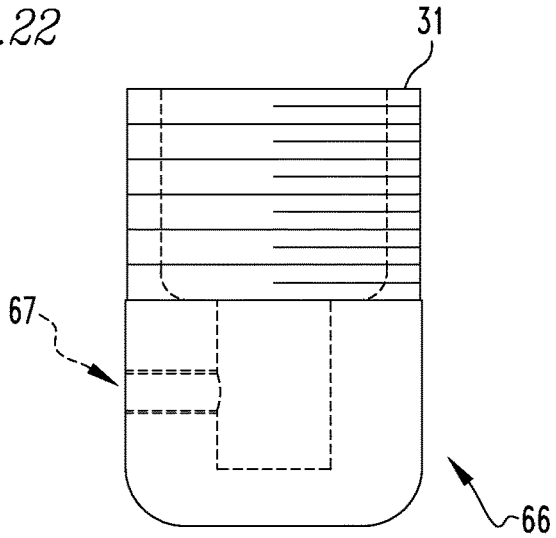
FIG. 24 is a side view of an end coupler.

The support structure 16 is made by taking couplers 22 and fireman hoses 56 and connecting them together, as shown in FIGS. 3-5. Along the top edge 58 on each side of the support structure 16, except for the very ends, four-port couplers 60, as shown in FIGS. 11-15, are used to connect the fireman hoses 56. The end 57 of a fireman hose 56 is positioned over each fitting 31 of the four-port coupler 60 and a clamp 64 is placed on the end 57 of each fireman hose 56 and the respective fitting 31 on which the fireman hose 56 is disposed to clamp the fireman hoses 56 in place. At each end of a top edge 58, a three port, coupler 62, as shown in FIGS. 16-19, is used to connect the fireman hoses 56. At the bottom 17 of each fireman hose 56 that extends down from the three or four port couplers is an end coupler 66, as shown in FIGS. 20-25 that has one fireman hose 56 clamped to its fitting 31, and possibly a check valve 116 or an inflation hose 91 or deflation hose 120, as shown in FIG. 20, depending on which port it is.

Figure 8:
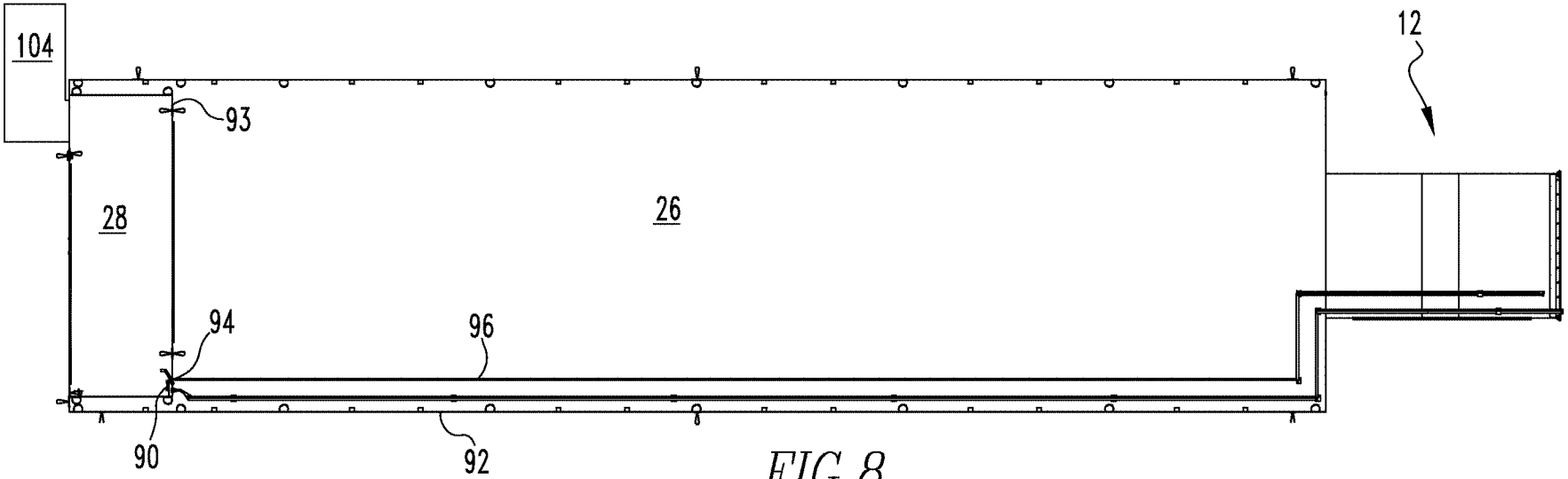
FIG. 8 is an overhead cutaway view of the deployed refuge shelter showing the purge hose and the airlock inflation hose.
Figure 9:
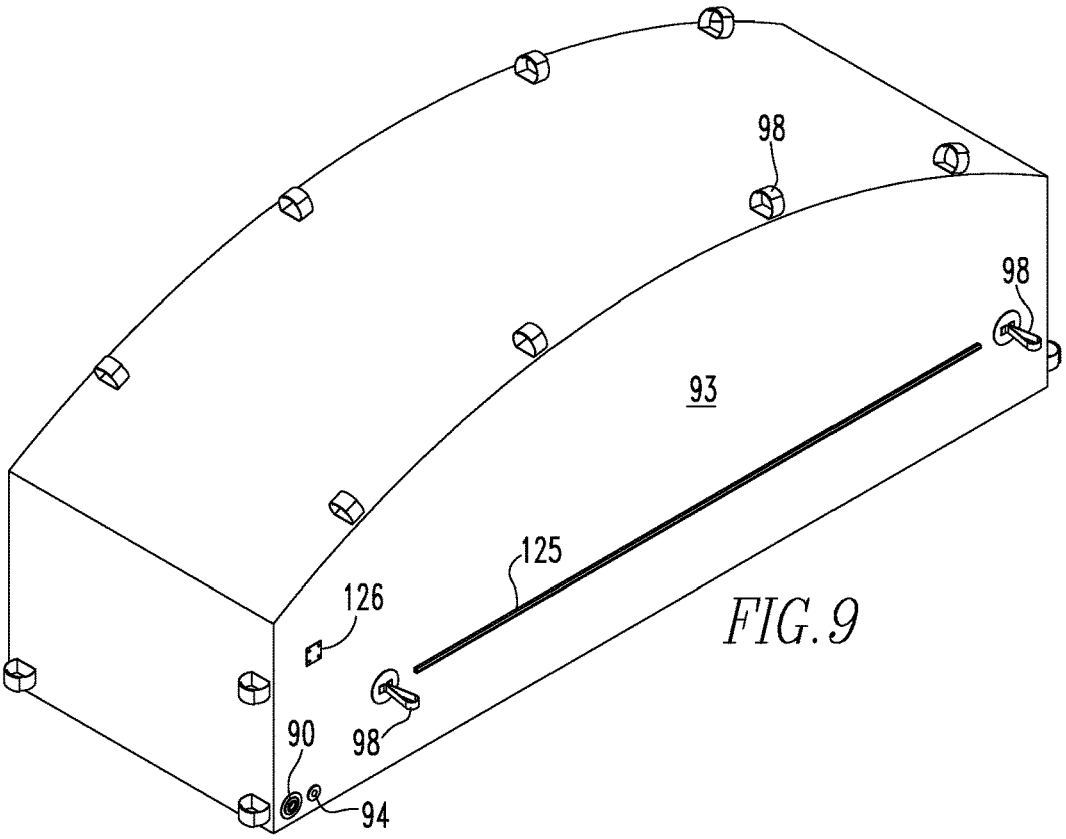
FIG. 9 is a perspective view of the airlock showing the internal wall from the main tent chamber 26.
Figure 10:
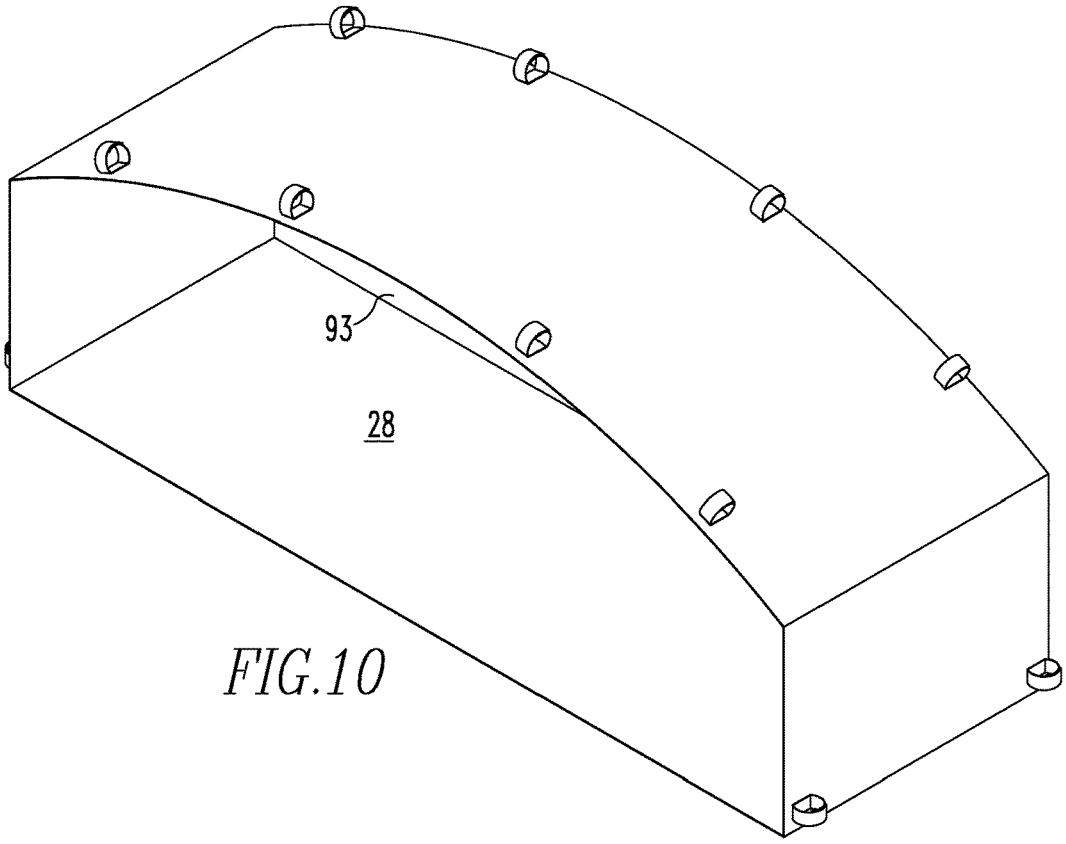
FIG. 10 is a perspective view of a cutaway view of the airlock from outside and in front of the deployed tent.

The tent 14 may include a main tent chamber 26 that has the protected environment and an air lock 28, as shown in FIGS. 8, 9 and 10, through which miners access the main tent chamber 26. The container 12 may be metal and may withstand an explosive force of at least 15 psi. The container 12 may be portable. The refuge shelter 10 in the deployed state may provide at least 15 square feet of floor space per person and 30 to 60 cubic feet of volume per person according to the following:

| unrestricted volume (cubic Mining height (inches) feet) per person | |
|---|---|
| −36 or less | 30 |
| >36-<=42 | 37.5 |
| >42-<=48 | 45 |
| >48-<=54 | 52.5. |
| >54 | 60 |

As an example, an embodiment of the refuge shelter 10 that can hold up to 36 people, is 15'-6½" Long×6'-8½" Wide×3'-9" High. The outside steel plates that form the container 12 are ¼" thick so that the container is light enough to be portable yet strong enough to withstand at least a 15 PSI explosion.

The present invention pertains to a gas flow apparatus 30, as shown in FIGS. 5, 11, 36, 13, 14 and 15. The apparatus 30 comprises a housing 23 having at least three distinct barbed fittings 31, including a first barbed fitting 32, a second barbed fitting 34 and a third barbed fitting 36. The apparatus 30 comprises a first fireman hose 38 having an end 57 disposed over the first barbed fitting 32. The apparatus 30 comprises a second fireman hose 40 having an end 57 disposed over the second barbed fitting 34. The apparatus 30 comprises a third fireman hose 42 having an end 57 disposed over the third barbed fitting 36. The apparatus 30 comprises a first clamp 44 which fits over the first fireman hose 38 end 57 and the first fitting 34 to clamp the first fireman hose 38 to the first fitting 34. The apparatus 30 comprises a second clamp 46 which fits over the second fireman hose 40 end 57 and the second fitting 36 to clamp the second fireman hose 40 to the second fitting 34. The apparatus 30 comprises a third clamp 48 which fits over the third fireman hose 42 end 57 and the third fitting 36 to clamp the third fireman hose 42 to the third fitting 36. The housing 23 is hollow to allow fluid, such as gas, to flow through it through its ports 67. Each fitting 31 is a port 67 through which fluid flows. The first fitting 32 has an opening which defines a first port 50. The second fitting 34 has an opening which defines a second port 52. The third fitting 36 has an opening which defines a third port 54. Additional fittings each have an opening which defines a port 67. At least two of the fittings 31 have an angle between 91 degrees and 179 degrees between them. For instance, the first fitting 32 has an angle of between 91 degrees and 179 degrees with the second fitting 34, and preferably about 135 degrees.

Figure 13:
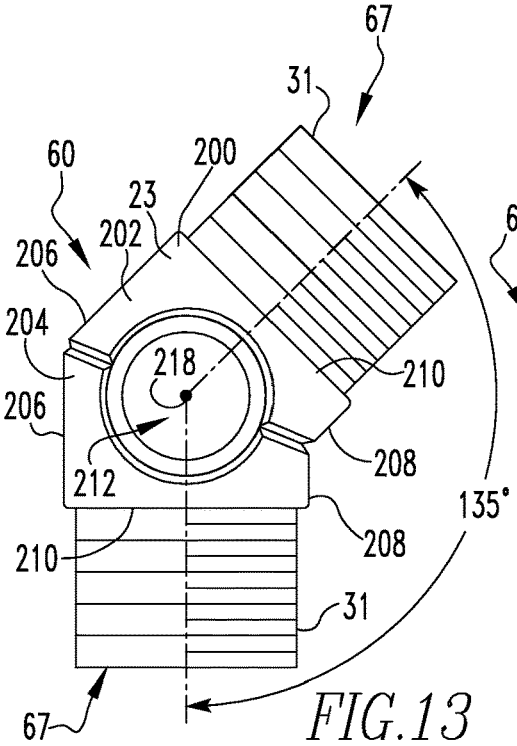
FIG. 13 is a side view of a 4 port coupler.
Figure 14:
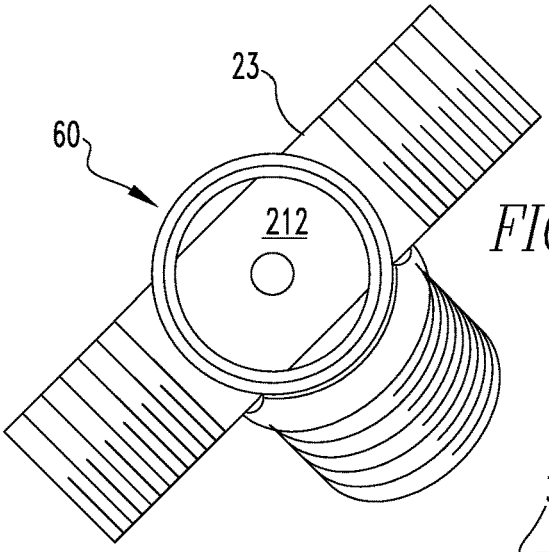
FIG. 14 is an overhead view of a 4 port coupler.
Figure 15:
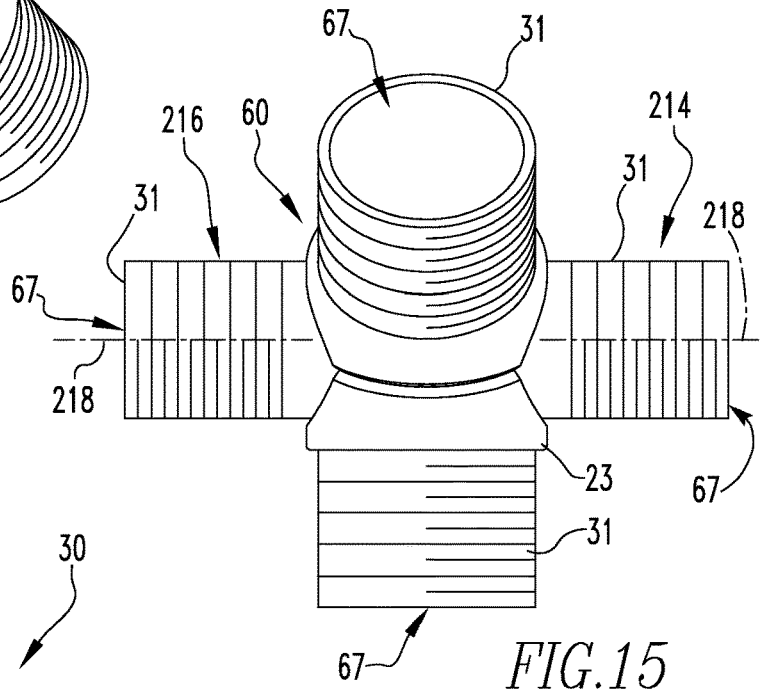
FIG. 15 is a front view of a 4 port coupler.

For a 4 port coupler 60, as shown in FIGS. 13 and 15, the housing 23 has a hollow central portion 200 having a first part 202 and a second part 204. Each part has a long side 206 and a short side 208. The long and the short sides of the first part 202 are connected to the long and the short sides of the second part 204, respectively, so that an angle greater than 0° and less than 180°, and preferably 135°, is formed between the long sides 206 of the first and second parts and the short sides 208 of the first and second parts. The first part 202 and the second part 204 each have an intermediate side 210 that extends between their respective short side 208 and long side 206. Each intermediate side 210 has an opening 212 from which a barbed fitting 31 extends outward from the central portion 200 defined by a threaded cylinder. The central portion 200 has a right side 214 and a left side 216. The right side 214 has an opening 212 from which a barbed fitting 31 extends defined by a threaded cylinder. The left side 216 has an opening 212 from which a barbed fitting 31 extends defined by a threaded cylinder which opposes and is in spaced relationship with the barbed fitting 31 of the right side 214 and whose central axis 218 is in linear alignment with the barbed fitting 31 of the first side 202. For a three port coupler 67, there is no port on the left side, just the central portion 200 being solid where the opening 212 is for the four-port coupler 60. The central portion 200, the first and second parts, and all the barbed fittings 31 are one continuous piece.

Figure 26:
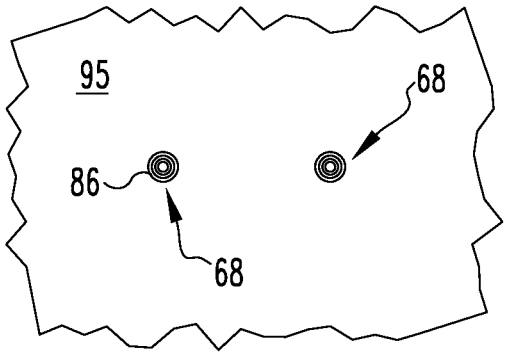
FIG. 26 shows the test ports.
Figure 27:
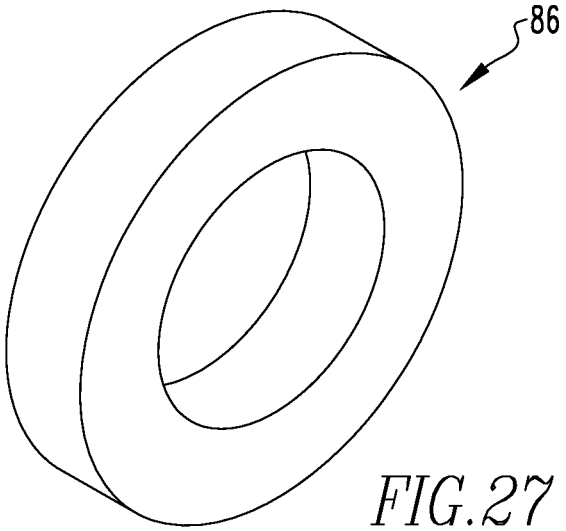
FIG. 27 shows a gasket of the test port.
Figure 28:
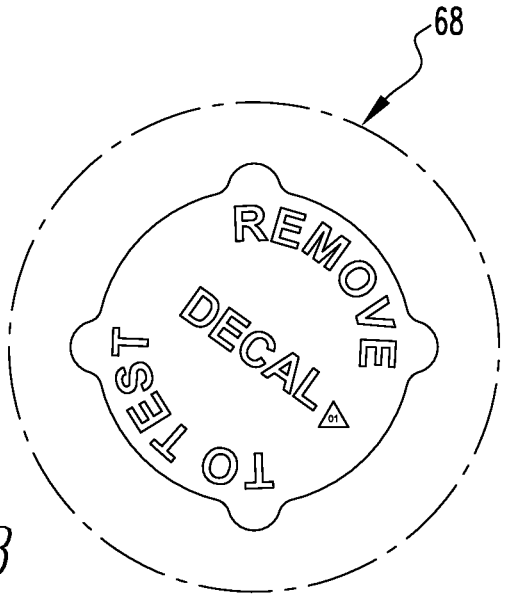
FIG. 28 shows a test port.
Figure 29:
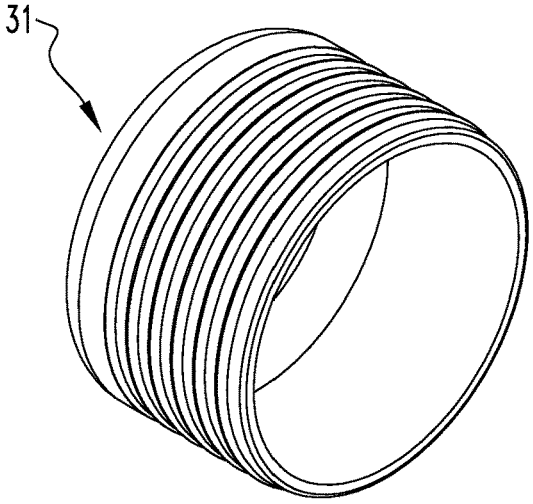
FIG. 29 is a perspective view of a barbed fitting.
Figure 32:
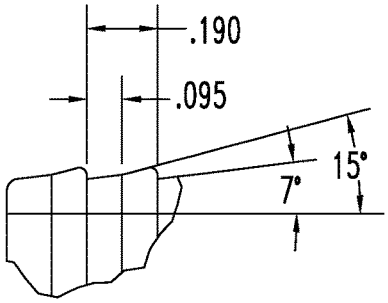
FIG. 32 shows the threading of the barbed fitting.
Figure 31:
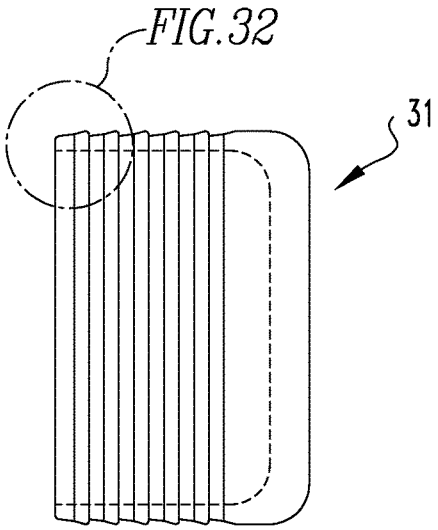
FIG. 31 is a side view of the barbed fitting.
Figure 30:
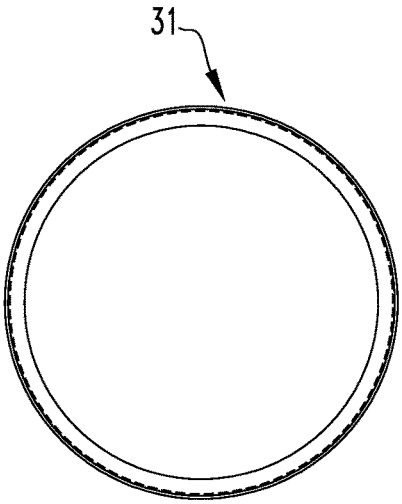
FIG. 30 is a left side view of the barbed fitting.
Figure 33:
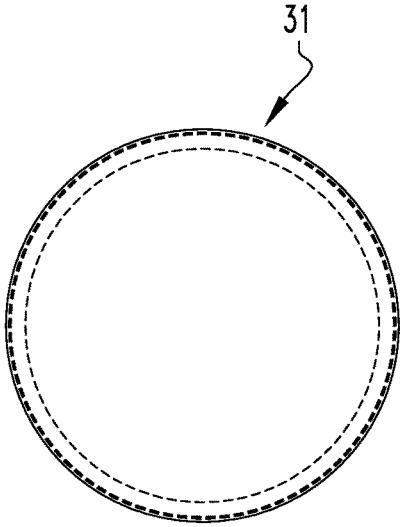
FIG. 33 shows a right side view of the barbed fitting.

The present invention pertains to a refuge shelter 10 for miners in a mine to protect the miners from the external environment, as shown in FIG. 1. The shelter 10 comprises a container 12. The shelter 10 comprises a tent 14 that is disposed in the container 12 in an undeployed state which is expandable to a deployed state and extends from the container 12 to provide a protected atmosphere for the miners. The container 12 is accessible from inside the tent 14, as shown in FIG. 2. The tent 14 has a test port 68, as shown in FIGS. 26, 27 and 28, to which a sample of the external environment can be obtained from inside the tent 14.

The present invention pertains to a method for providing a refuge shelter 10 for miners in a mine. The method comprises the steps of opening a container 12 made of metal. There is the step of expanding a tent 14 that is disposed in the container 12 in an undeployed state to a deployed state that extends from the container 12 to provide a protected atmosphere for the miners. The container 12 is accessible from inside the tent 14. The tent 14 includes an inflatable support structure 16 which is inflatable from an undeployed state to a deployed state, and a seal 18 which seals the tent 14 to the container 12 in a deployed state. The support structure 16 has a plurality of hoses 20 interconnected by couplers 22. The hoses 20 have an inside diameter of less than 5 inches. The container 12 includes a bank of compressed gas bottles 24 that are operable to inflate the support structure 16 thereby expanding the tent 14 to the deployed state.

In the operation of the invention, the fittings 31, as shown in FIGS. 29-33, for the hose connections are specialized items created to enable the hoses 20 to be constructed into a 3 dimensional skeletal form to define the support structure 16. Fittings 31 are part of 3 port couplers 62 (FIG. 17) (to connect hoses 20 coming in from 3 directions), 4 port couplers 60 (FIG. 12) (to connect hoses 20 coming in from 4 directions), and end couplers 66 (FIGS. 20 and 21) to plug ends of the hose legs at the "foot" location and allow interface with various other aspects needed to inflate and maintain inflation of the support structure 16—such as an inflation hose 91 (FIG. 34), pressure release valves, or a deflation hose 120 (FIG. 3). The fittings 31 are made of aluminum.

Figure 11:
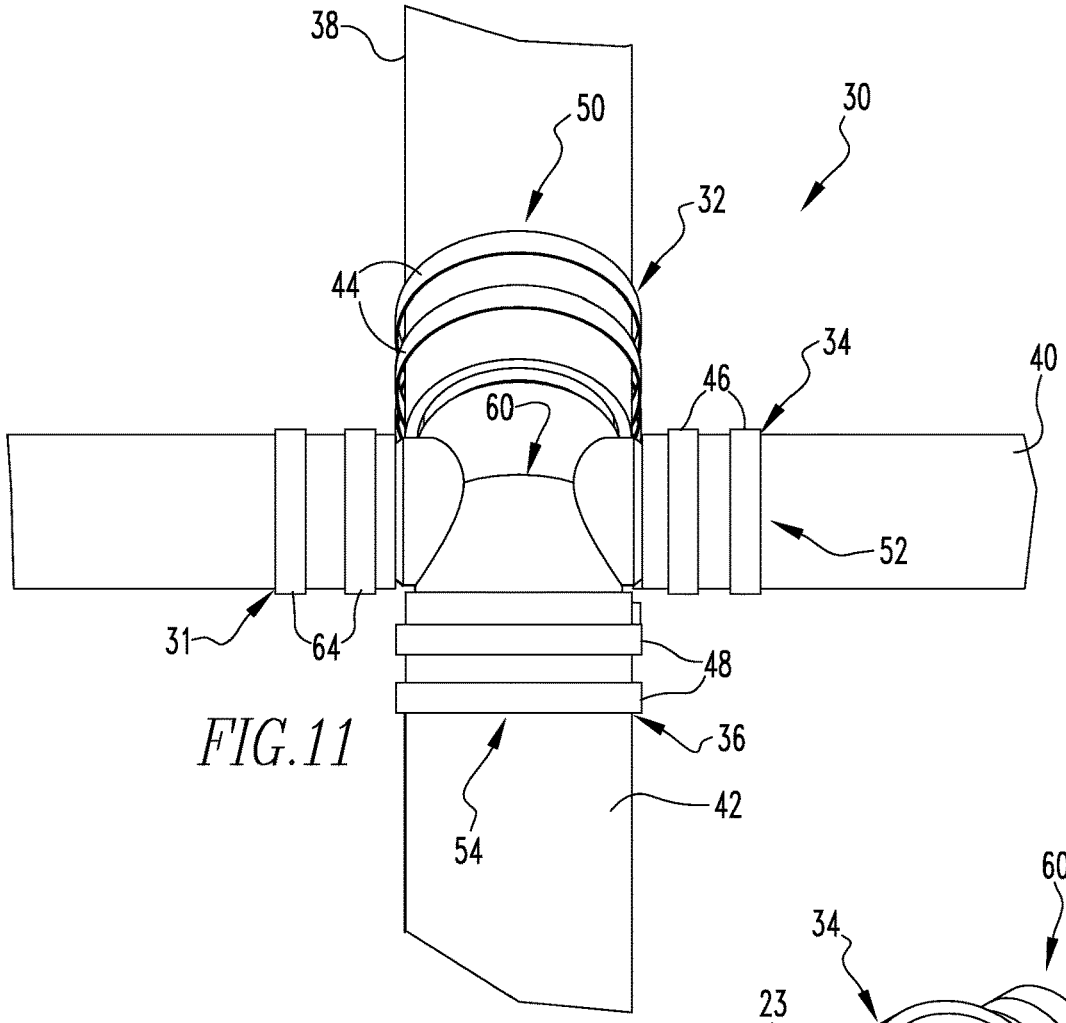
FIG. 11 is an overhead view of a 4 port coupler.
Figure 12:
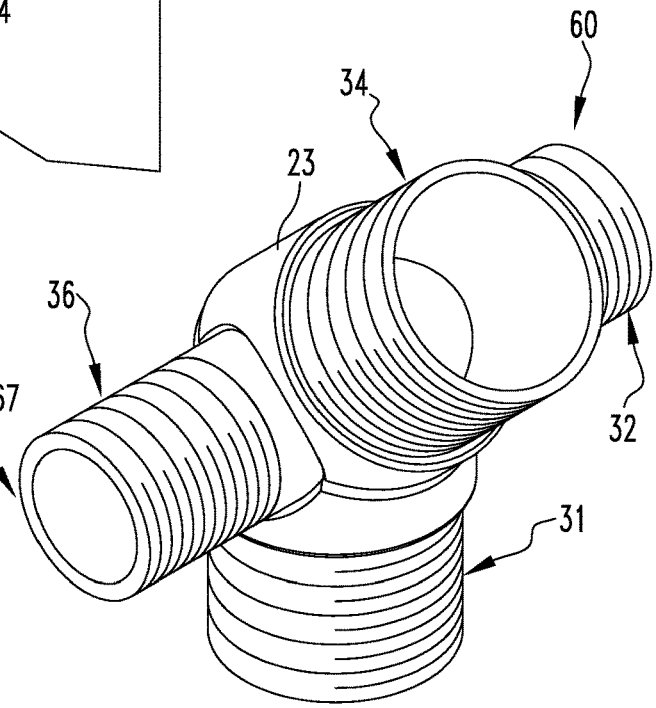
FIG. 12 is a perspective view of a 4 port coupler.

The hose fittings 31 are "barb" fittings 31. Retention of the hose 20 is accomplished by inserting the hose 20 over the barbed fitting 31 and applying a clamp 64, such as a worm gear clamp, over the barbed area of the fitting 31, as shown in FIG. 11. Shrink wrap may be used to cover the clamp 64 to prevent tampering and to blunt any sharp edges the clamp 64 may have so that it does not damage the canopy or other hose sections. The angular attitude of the opposing fittings 31 on either side of the shelter 10 are not linearly aligned, therefore the hose 56 being more flexible than the fittings 31 causes the hose 56 to flex, resulting in an arc from one fitting to the other, side to side over the width of the shelter 10.

Figure 39B:
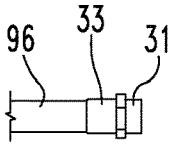
FIG. 39 shows a purge hose.
Figure 39:
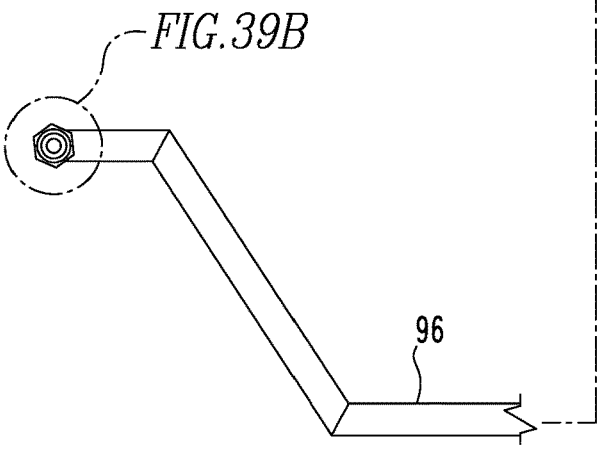
Figure 39:
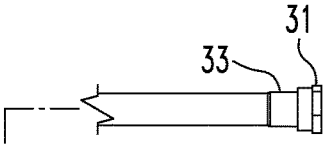
Figure 40:
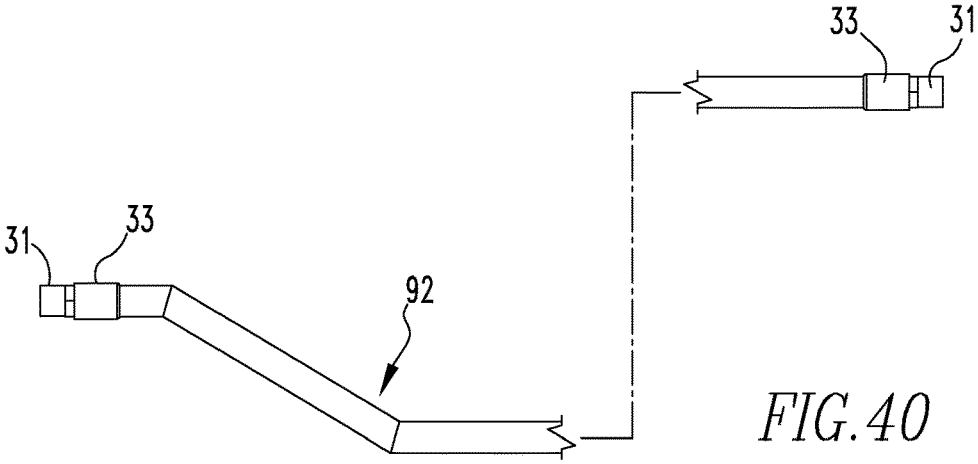
FIG. 40 shows an airlock hose.

The inside diameter of the hose 20 should be less than 5". The two hose 20 sizes preferably used in the structure have a 1.75" and 2.5" ID, as shown in FIGS. 35-38. The purge hose 96, shown in FIG. 39, and the air lock hose 92, shown in FIG. 40, are formed with an EPDM rubber liner sealed with a polyester braided over-wrap jacketing that is resistant to flammability for MSHA approval, and is rated to support up to 500 psi of pressure. The purge hose 96, which can be purchased from Goodyear Horizon, and the airlock hose 92, which can be purchased from Parker Hannifin, each have ends with barbed fittings 36 and ferrules 33 for attachment purposes. The hose 20 used for the support structure 16 is a fireman hose 56, typically used by fireman, which has a rubber liner, such as a neoprene liner and a polyester or nylon filament sleeve. The fireman hose 56, in a folded state, is able to fold flat when stowed, and is rated to support up to 300 psi of pressure. Typical pressure maintained in the inflated structure is 40-80 PSI. The fireman hose 56 can be purchased from Key Fire Hose having, for instance, Part No. SP17 or SP 25.

Figure 44:
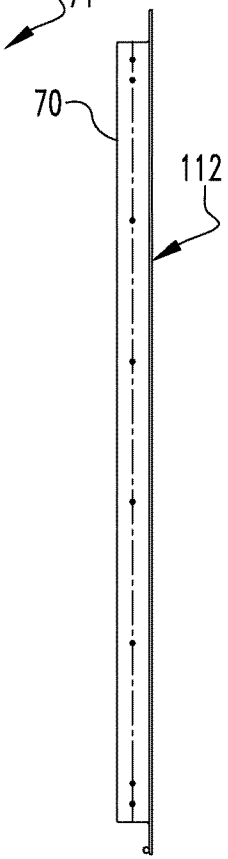
FIG. 44 shows a metal flange, short, of the tent adapter frame.
Figure 42:
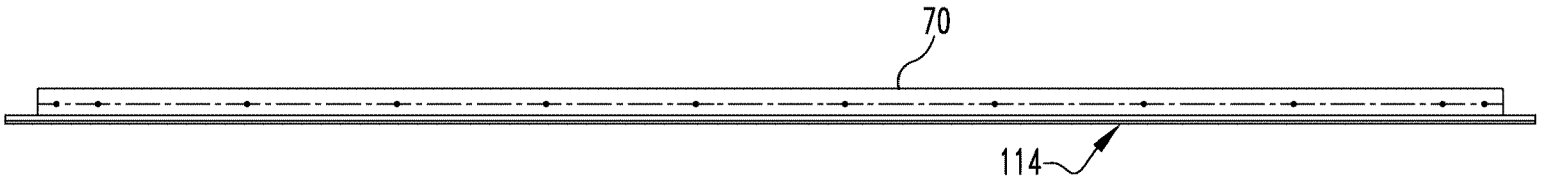
FIG. 42 shows a metal flange, long, of the tent adapter frame.
Figure 43:
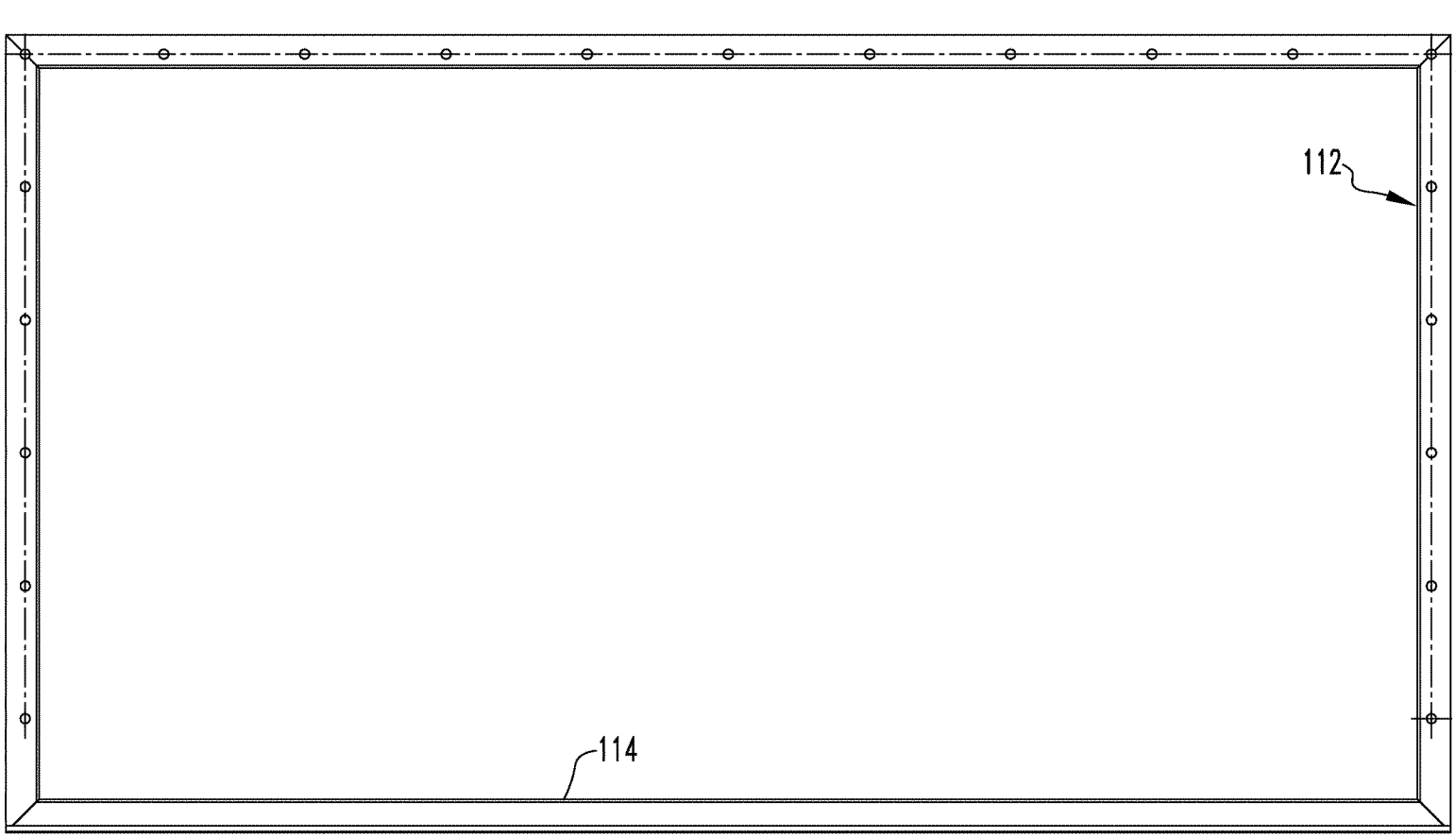
FIG. 43 shows the tent adapter frame.

FIG. 6 shows the transition from the soft-sided shelter 10 fabric (tent in) to the hard metal rectangular frame 71 (container 12). The transition from fabric to metal is achieved through a permanent mechanical connection where the fabric is trapped between two metal flanges 70, one belonging to the frame 71, and the other being the backing bar 72. A rivet 74 is passed through all to permanently join them together. The tent adapter frame 71 is a mechanical interface to transition from the soft sided shelter 10 fabric to the hard shelled steel container 12. It is a metal frame 71 that is rectangular in shape that is very nearly a scale representation of the cross sectional profile of the container 12, but smaller. On one side, it is attached to the soft-sided tent 14, and is therefore part of the Canopy Weldment sub-assembly 73. When the soft-sided tent 14 is joined to the steel container 12, it is here that the two interface. The rectangular frame 71 is simply bolted to a bulkhead 80 inside the steel container 12 with a perimeter row of bolts 82. Between the frame 71 and bulkhead 80 is a perimeter foam seal 84 to promote leak integrity. The tent adapter frame 71 is also shown in step 4 of FIG. 41. Generically, FIGS. 42, 43 and 44 show the frame 71 singularly. The transition is formed into an air tight seal 18 between the tent 14 fabric and metal container 12.

Figure 45:
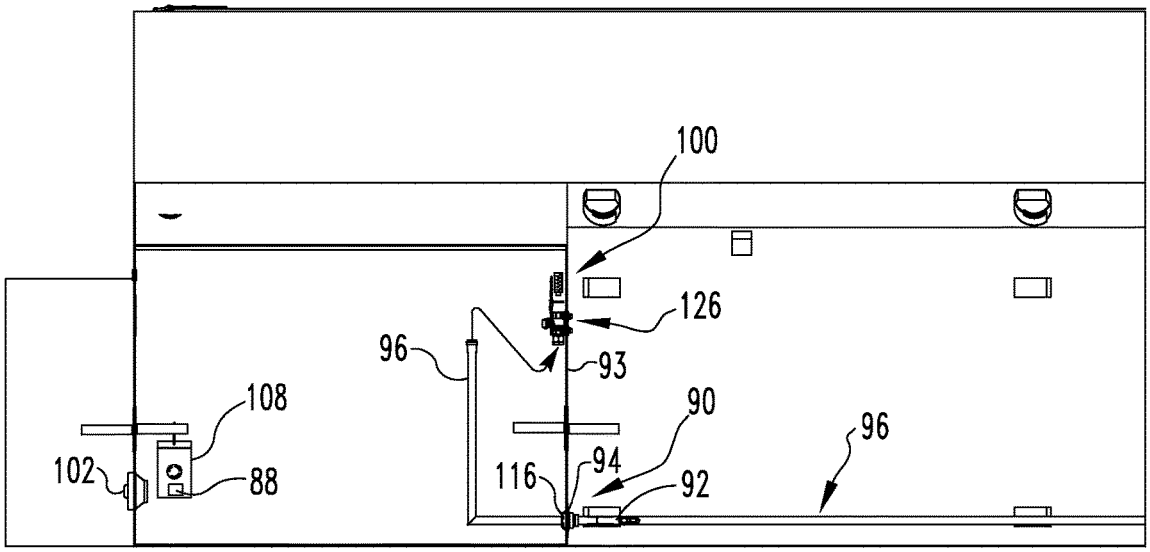
FIG. 45 shows the airlock and interface at the interior wall of the airlock with the main tent chamber.
Figure 46:
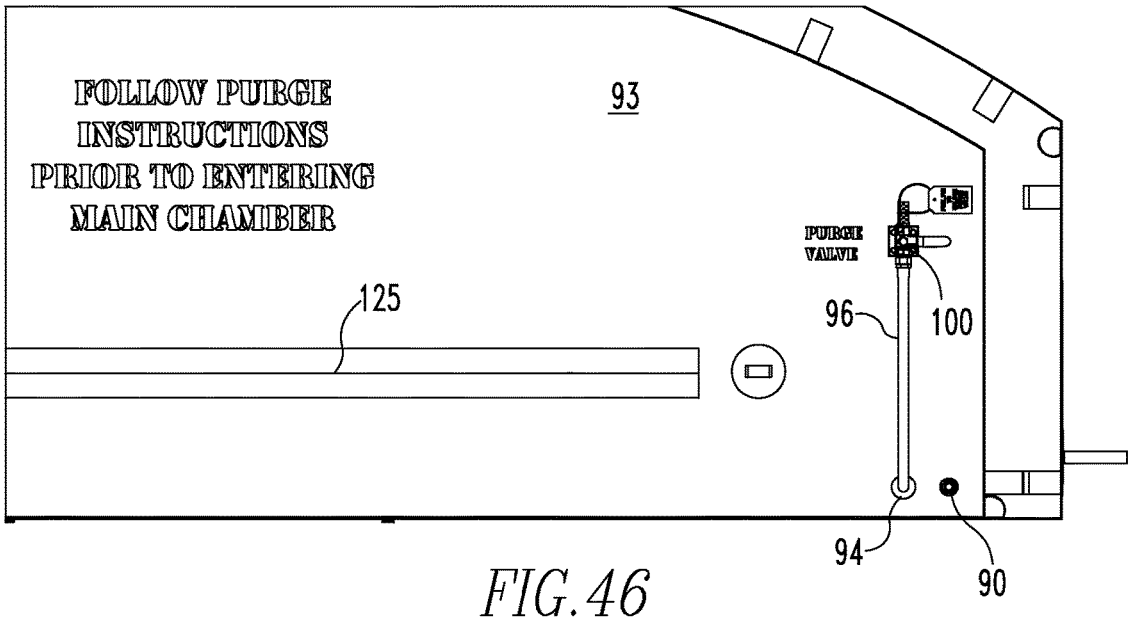
FIG. 46 shows a partial view of the interior wall of the airlock from inside the airlock.

The air test port gasket 86, shown in FIG. 27, is a small gasket used to seal the fabric-to-plastic interface at the grommet 94 that is installed into the shelter 10 interior wall 93 to act as a "Test Port" 68 opening in the tent 14 through which gas can be drawn in to sample the air environment outside the shelter 10. The test port opening is plugged with an ear plug 88 when not in use. Ear plugs 88 are held in an earplug bag 108, as shown in FIG. 45.

There are for instance the following occupancies for the refuge shelter 10: 18, 24, 30, 36 men. The model designations are as follows:

1618-4.0-2018
2624-4.0-2018
2630-3.0-2018
3636-4.0-2018

Nomenclature Example: using the 1618-4.0-2018 listed above, the "16" represents the steel chamber that the shelter 10 bolts onto (a traditional 16 man sized box), the "18" represents the size/occupancy of the inflatable shelter 10 (18 persons), the "4.0" represents the shelter's 10 nominal height (4.0 feet), "2018" representing the fact that the size of the shelter 10 is intended to comply with the Code of Federal Regulations (CFR) governing the floor space and volume requirements for mine refuges in the year 2018.

Referring to FIGS. 8, 9, 10, 45 and 46, the base flange 90 is used to connect the air lock hose 92 to the airlock 28. The airlock 28 is one of three volumes that are inflated using air diverted from the single source high pressure bottles 24 at the time of inflation. The grommet 94 allows the physical passage of the purge hose 96 (used for discharging purge air bursts) thru the interior wall 93 of the air lock 28—essentially it is a rubber donut to seal around the outer diameter of the purge hose 96 to prevent air volume communication between the air lock 28 and main tent chamber 26 of the shelter 10. Loops 98 are hand-holds to assist the user of the refuge shelter 10 to operate the zipper(s) 125. There is a need to have an opposing object to grab onto while operating the zippers 125—as they take considerable force to open and close due to their air-tight/water-tight design. The air lock inflation hose 92 fills the air lock 28 with air while the purge hose 96 is simply to bring in purge air. The purge air is released by a purge valve 100 located in the air lock 28 that is manually operated. See FIGS. 47 and 48. The purge valve 100 has an adapter 191 to which the purge hose 96 attaches, a handle 192 to open and close the purge valve 100 and a muffler 193. The purge valve itself is standard and can be purchased from McMaster Carr. The purge valve 100 is held to the interior wall of the air lock 28 with a purge valve mount 126, as shown in FIGS. 49-52, which is a fabric reinforcement patch welded on both sides of the air lock interior wall 93. The purge valve mount 126 has end tops 163 with holes 165 in which the purge valve 96 is held to the mount 126.

There is at least one pressure release valve 102 and possibly two located at about each bottom corner in the exterior wall 95 of the air lock 28, through which excess pressure in the air lock 28 is released to the outside atmosphere. The air lock hose 92 extends through the base flange 90 in the interior wall 93 of the air lock 28 to fill the air lock 28. There is also a pressure release valve 102 positioned at the top front of the container 12 for excess pressure to be released from the main tent 14 chamber, as shown in FIG. 1.

Figure 53:
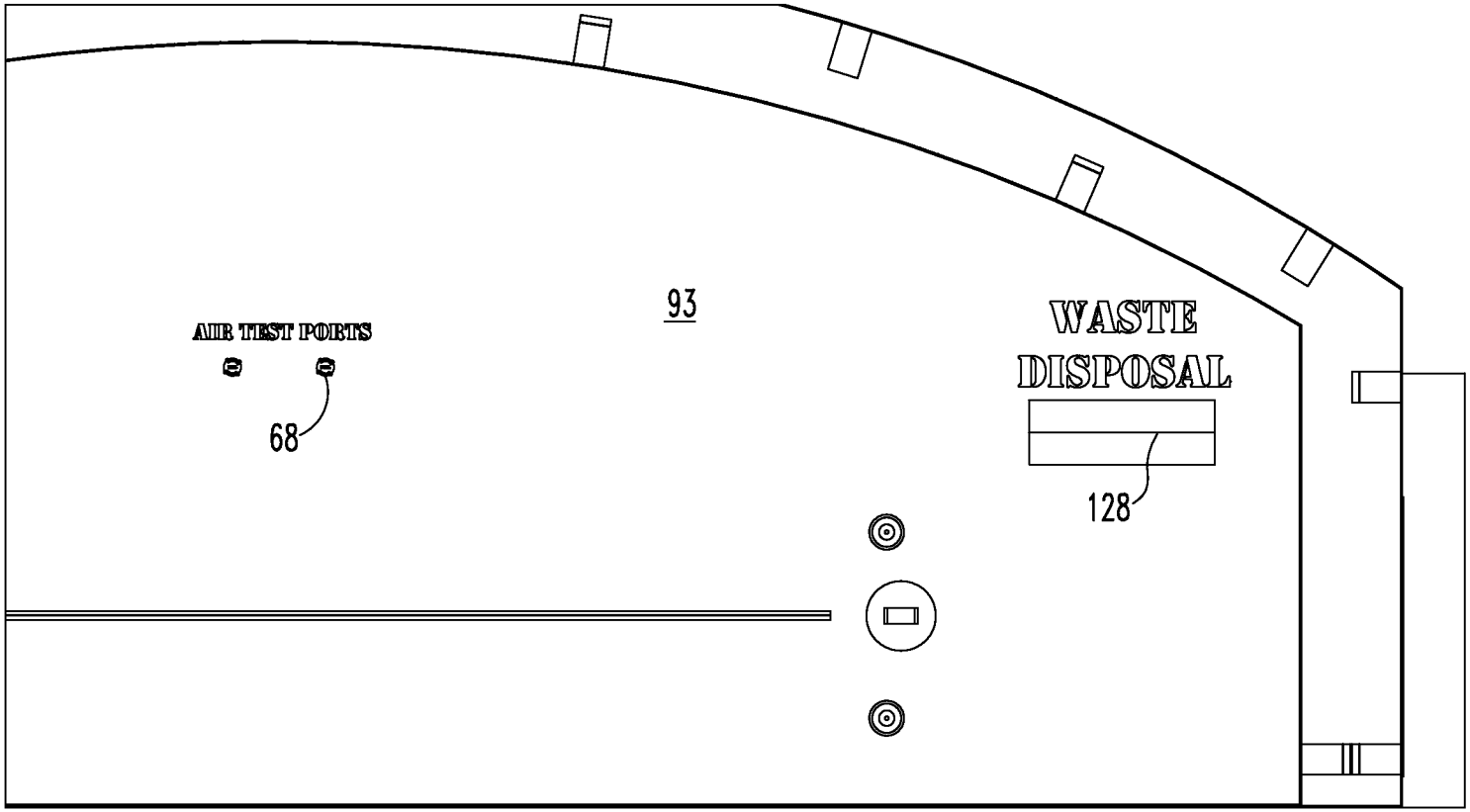
FIG. 53 shows a partial view of the exterior wall of the airlock from inside the airlock.
Figure 54:
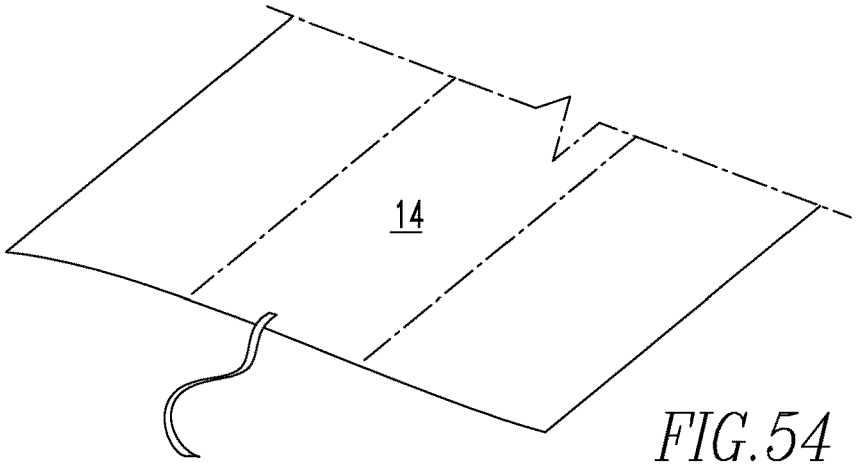
FIG. 54 shows the undeployed tent as it is about to be folded.
Figure 55:
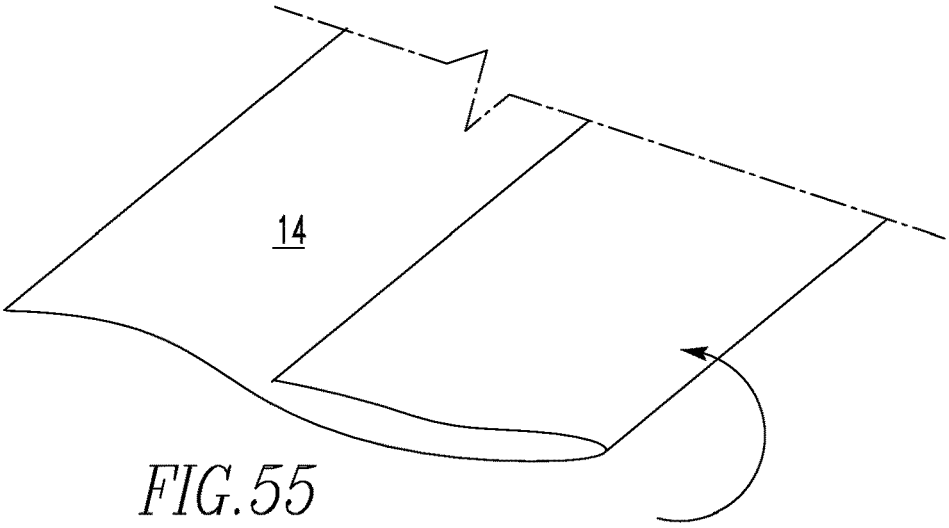
FIG. 55 shows the undeployed tent as it is being folded.
Figure 56:
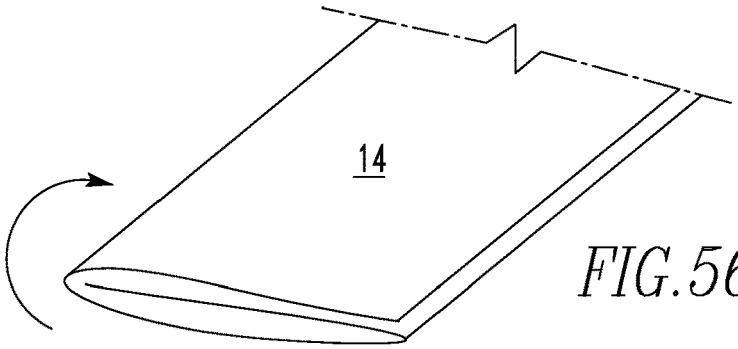
FIG. 56 shows the undeployed tent folded in preparation to be rolled up and placed inside the container.

FIG. 1 shows the refuge shelter 10. There is the metal container 12 with the deployed and inflated tent 14 that has the main tent chamber 26 for occupants and an air lock 28 disposed at the opposite end of the container 12. There is a waste box 104 connected, such as by sewing, to the exterior wall 95 of the tent 14. There is a zipper 125 in the exterior wall 95 that when opened, allows access to the waste box 104 to place waste into the box 104, as shown in FIG. 53. The zipper 125 to the waste box 104 can then be closed to seal off the waste box 104 from the air lock 28. The main tent chamber 26 can support occupants, such as miners for at least 96 hours. Stored in the container 12 are supplies, such as food and water, pressurized gas bottles 24 such as air and oxygen tanks and an air powered CO2 scrubber 106. The CO2 scrubber 106 is moved into the main tent 26 chamber upon deployment of the refuge shelter 10. See U.S. patent application Ser. No. 13/460,252 and U.S. patent application Ser. No. 12/075,002, both of which are incorporated by reference herein. If an air conditioner is desired to be added to the shelter 10, see U.S. patent application Ser. No. 13/900,236, incorporated by reference herein.

Figure 41:
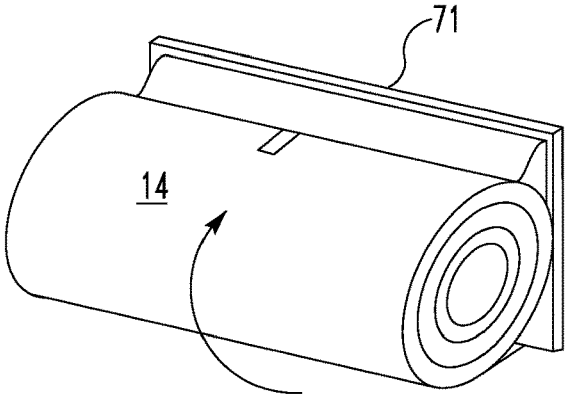
FIG. 41 shows a tent in an undeployed state attached to the tent adapter frame.

FIGS. 41 and 54-56 show tent 14 folding instructions to store the tent 14 in the container 12. FIG. 41 shows the tent adapter frame 79 attached to the tent 14. FIGS. 3-5 show the interior refuge support structure 16. The interior refuge support structure 16 is made out of fireman hose 56 connected together with 2, 3 or 4 port couplers. In regard to FIG. 3, an inflation hose 91 is attached to the fitting of an end coupler 66 at the bottom of the fireman hose 56 at the front left of the support structure 16, and a purge hose 96 is connected to the fitting of an end coupler 66 at the bottom of the hose 56 at the front right of the support structure 16.

There can be a check valve 116 disposed at the end coupler 66 at the bottom of the hose 56 at the right side at the rear of the support structure 16 and also at the end coupler 66 which receives the inflation hose 91, so pressurized air cannot return back through those points, for instance back through the inflation hose 91.

Figure 16:
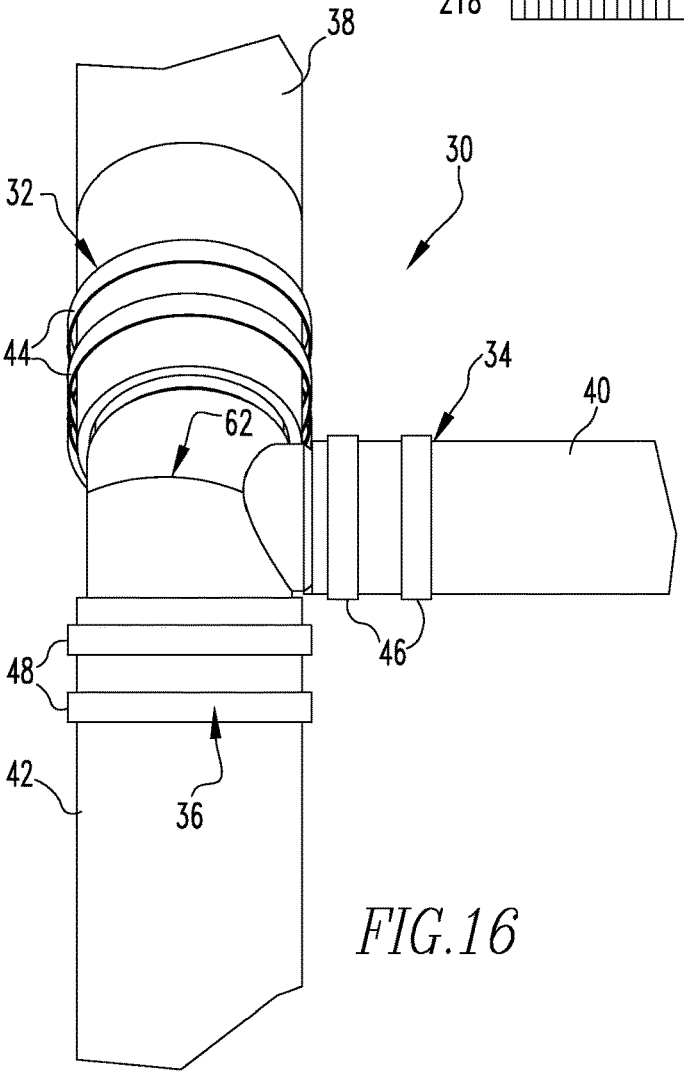
FIG. 16 is an overhead view of a 4 port coupler.
Figure 17:
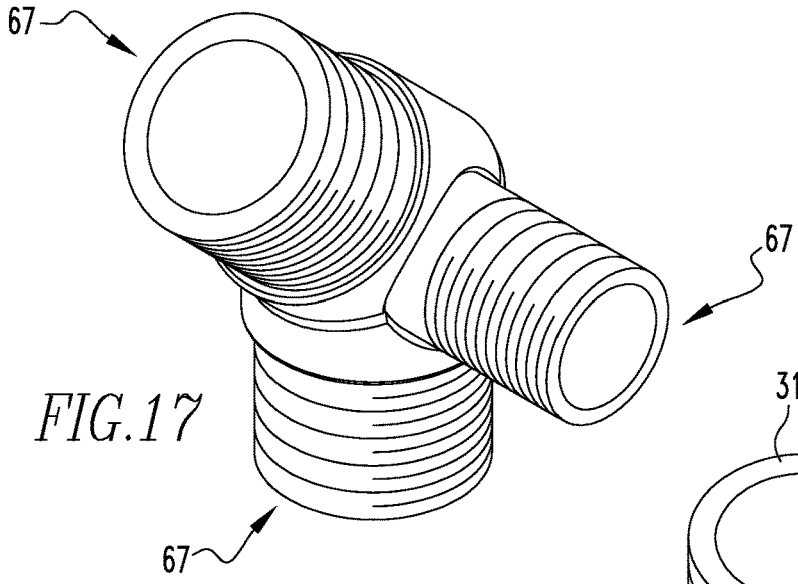
FIG. 17 is a perspective view of a 3 port coupler.

FIG. 11 shows fireman hoses 56 connected to a 4 port coupler 60. FIG. 16 shows fireman hoses 56 connected to a 3 port coupler 60. FIG. 20 shows an end coupler 66 with an inflation hose 91 and a fireman hose 56 connected to the end coupler 66. FIGS. 29-33 show a barbed fitting 31 of a coupler 22. The end 57 of a fireman hose 56 is placed over the barbed fitting 31 of the coupler 22 and a clamp 64 is then placed on the end 57 of the fireman hose 56 and over the barbed fitting 31 of the coupler 22 and then closed to hold the fireman hose 56 to the barbed fitting 31 of the coupler 22. FIGS. 12-15 show a 4 port coupler 60. There is an angle of 135° between two of the ports 64. FIGS. 17-19 show a 3 port coupler 62. There is an angle of 135° between two of the ports 67.

Figure 34:
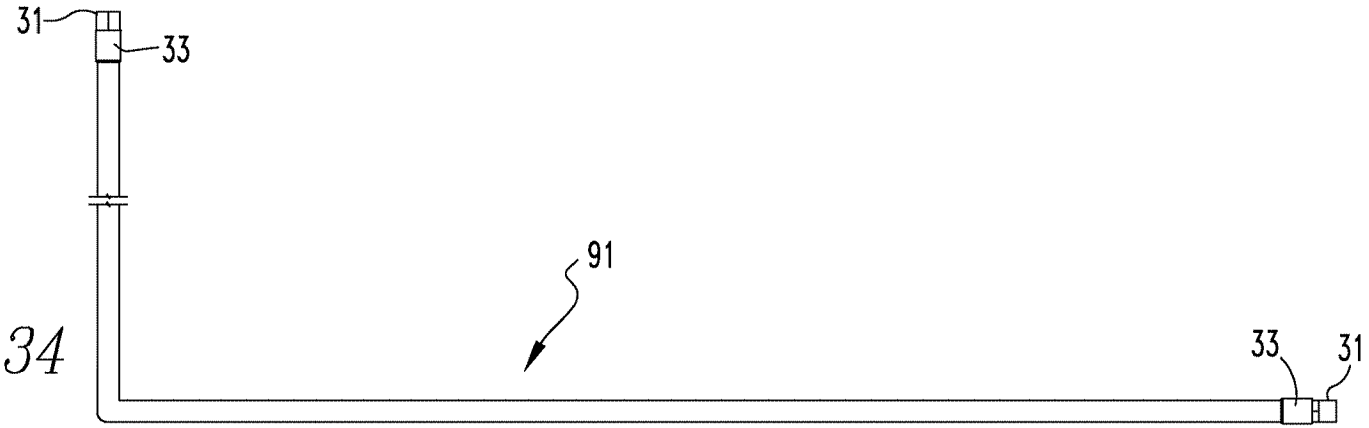
FIG. 34 shows an inflation hose.
Figure 36:
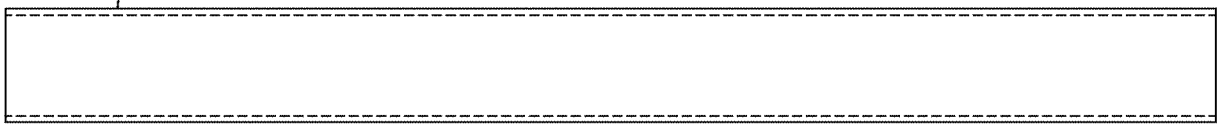
FIG. 36 shows a side view of a fireman hose.
Figure 35:
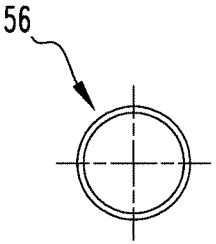
FIG. 35 shows an axial view of a fireman hose.
Figure 37:
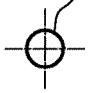
FIG. 37 shows an axial view of a fireman hose with a smaller diameter than the fireman hose sound in FIG. 36.
Figure 38:
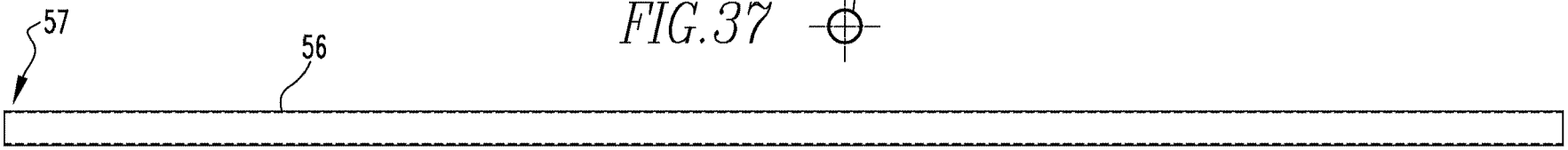
FIG. 38 is a side view of a fireman hose are FIG. 37.

FIG. 34 shows an inflation hose 91 that is used to connect to the fireman hose, through an end coupler 66, as shown in FIG. 3. FIGS. 21-25 show a machined and threaded barbed end coupler 66. The end coupler 66 can have a port 67 to receive a valve or a hose in addition to the fireman hose 56.

Figure 57:
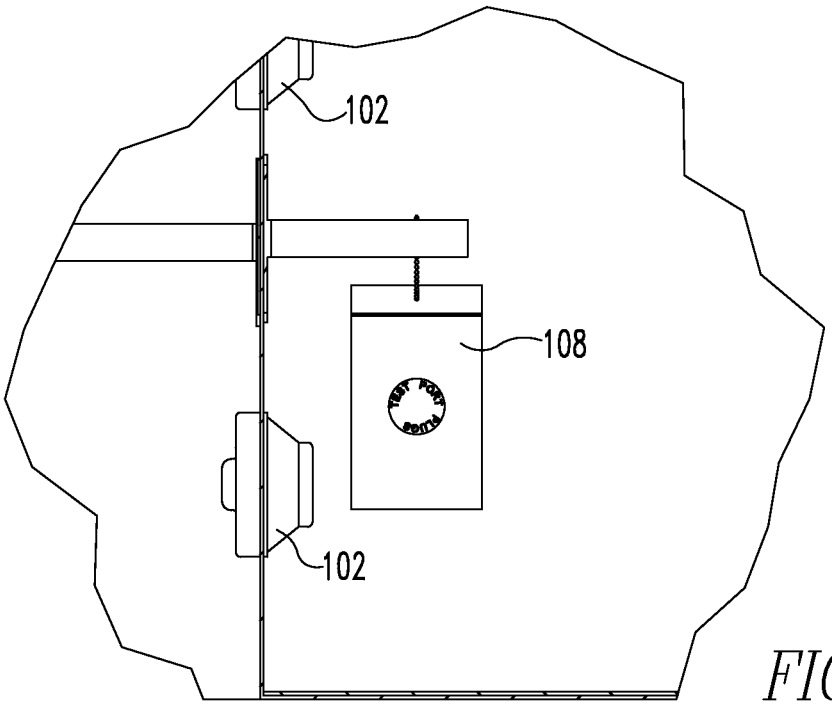
FIG. 57 shows the ear plug bag.

FIG. 26 shows the test ports 68. FIG. 57 shows a pressure release valve 102 and also an earplug bag 108 for holding the ear plugs 88 that plug the test ports 68. FIG. 9 shows the internal wall 93 of the air lock 28 and the base flange 90 and grommet 94 on the lower left side, viewed from inside the main tent chamber 26, through which the air lock 28 inflation hose 91 and the purge hose 96 extend, respectively. The purge hose 96 extends through the grommet 94. FIG. 9 shows the airlock inflation hose 91 and the purge hose 96 extending from the container 12 to the airlock.

The hose support structure 16 is attached to the interior of the tent 14, for instance, with velcro strips that are attached to the interior of the tent 14 to fit over the fireman hose 56 at regular intervals along the tent 14. FIG. 9 shows the air lock 28 with the interior wall 93 of the air lock 28 that is sewn to the tent 14 to define the airlock at the end of the tent 14. There is a zipper 125 in the interior wall 93 of the air lock 28 to allow inhabitants to pass from the air lock 28 to the main tent chamber 26. There is also a zipper 125 on the exterior wall 95 of the air lock 28 to allow miners or others to enter into the air lock 28.

Figure 47:
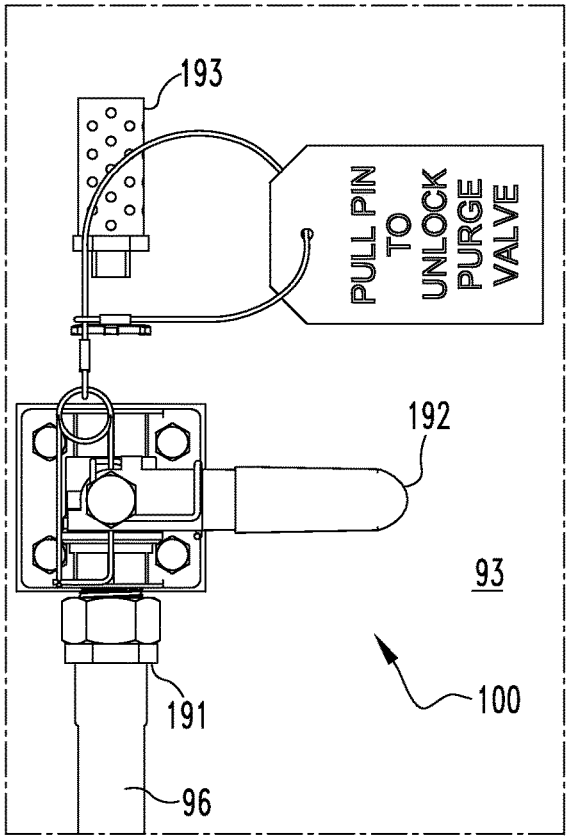
FIG. 47 shows a front view of the purge valve.
Figure 48:
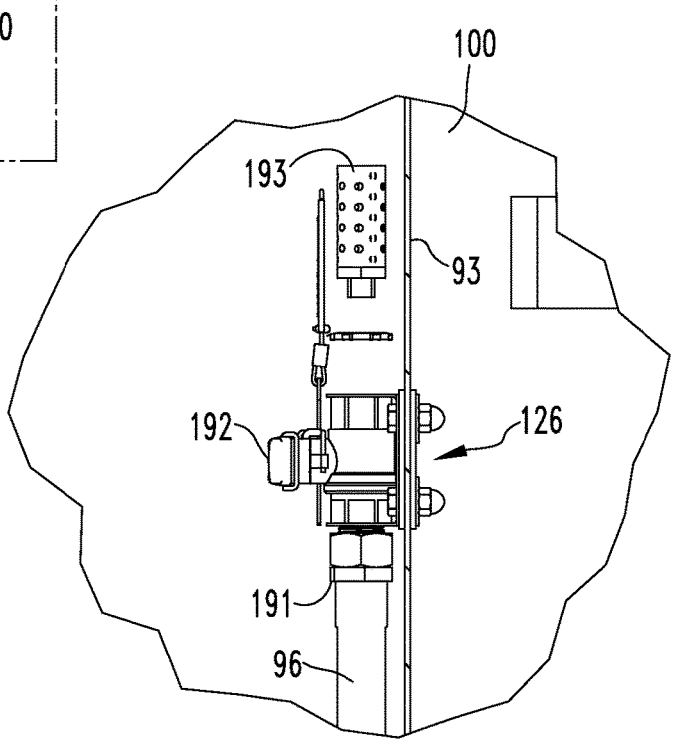
FIG. 48 shows a side view of the purge valve.
Figure 49:
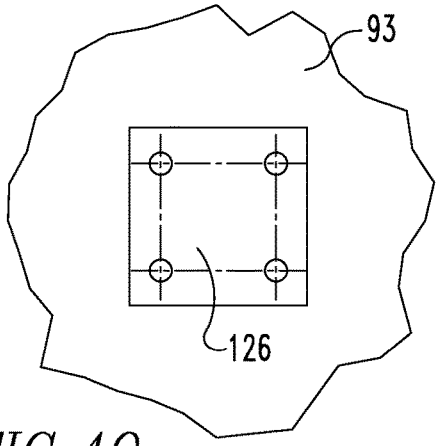
FIG. 49 shows the purge valve mount.
Figure 50:
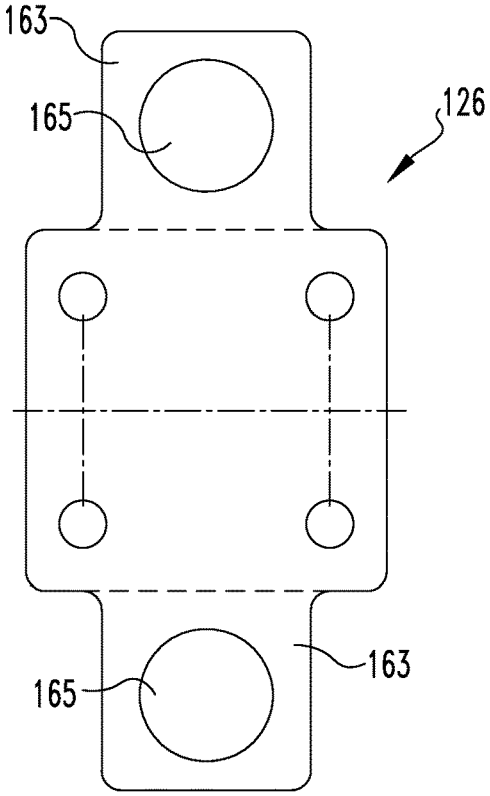
FIG. 50 shows an overhead view of the purge valve mount.
Figure 51:
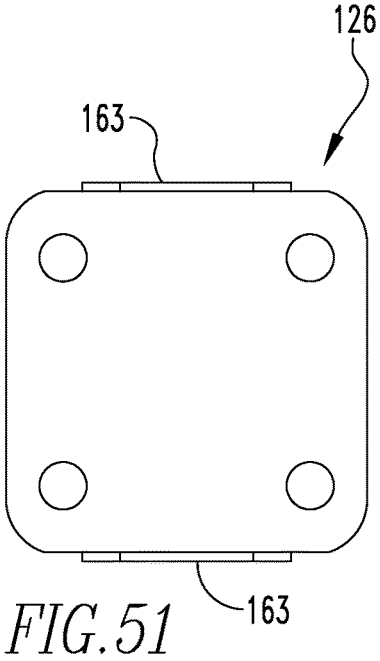
FIG. 51 shows a front view of the purge valve mount.
Figure 52:
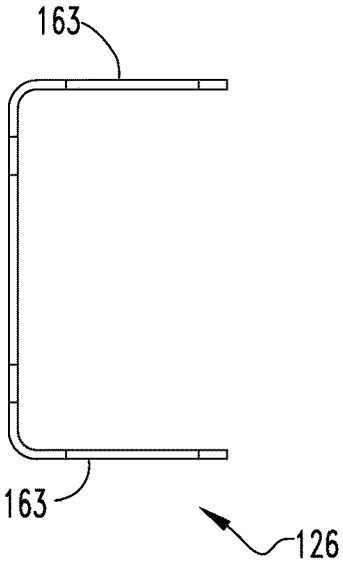
FIG. 52 shows a side view of the purge valve mount.

FIG. 47 shows the purge valve tag 110 that instructs a miner in the airlock to pull the pin to unlock the purge valve 100 so the purge valve 100 can be manually operated. Positive pressure can also be used to keep the external environment out of the deployed shelter 10. The pressure release valves 102 in the air lock 28 and in the container 12 vent any extra pressure to avoid any type of undesired pressure build up inside the shelter 10. The air and oxygen that flows continuously through the scrubber 106 from the pressurized bottles 24 provides the source of constant gas to maintain the over pressure in the shelter 10. FIG. 27 shows the air test port gasket 86 that is placed in the exterior wall 95 of the tent 14 in the air lock 28.

Figure 58:
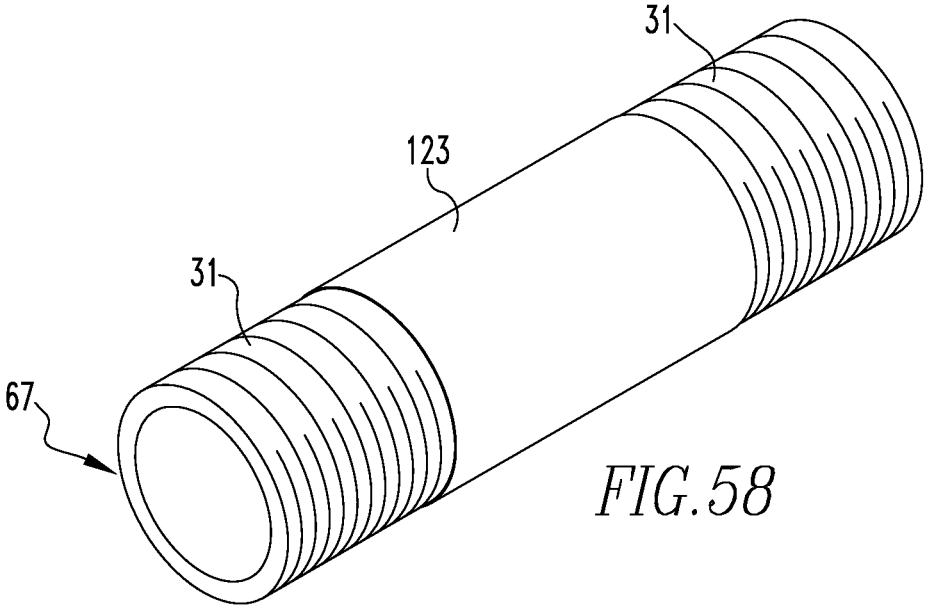
FIG. 58 shows a 2 port coupler.
Figure 59:
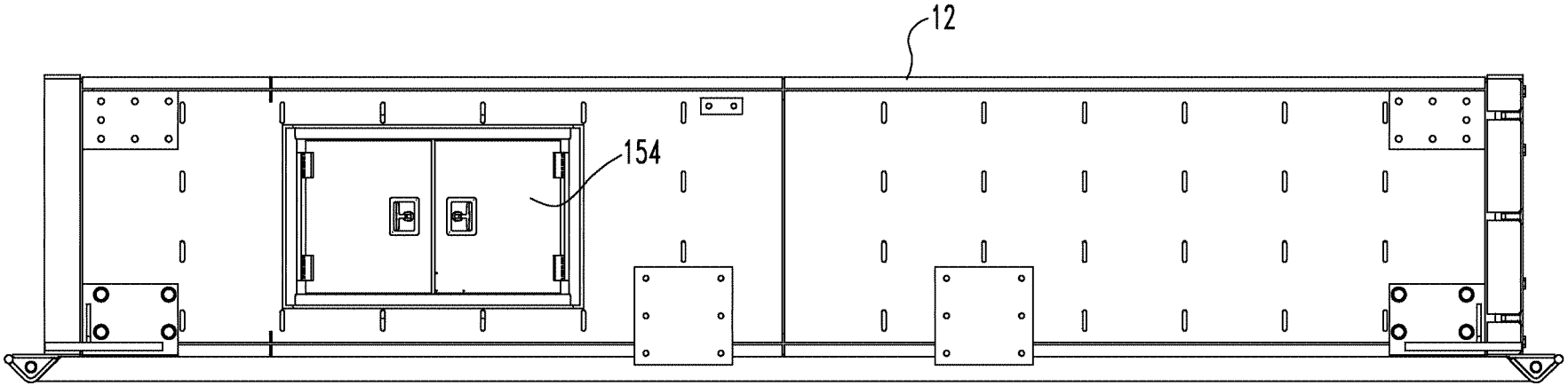
FIG. 59 shows a side view of the container
Figure 60:
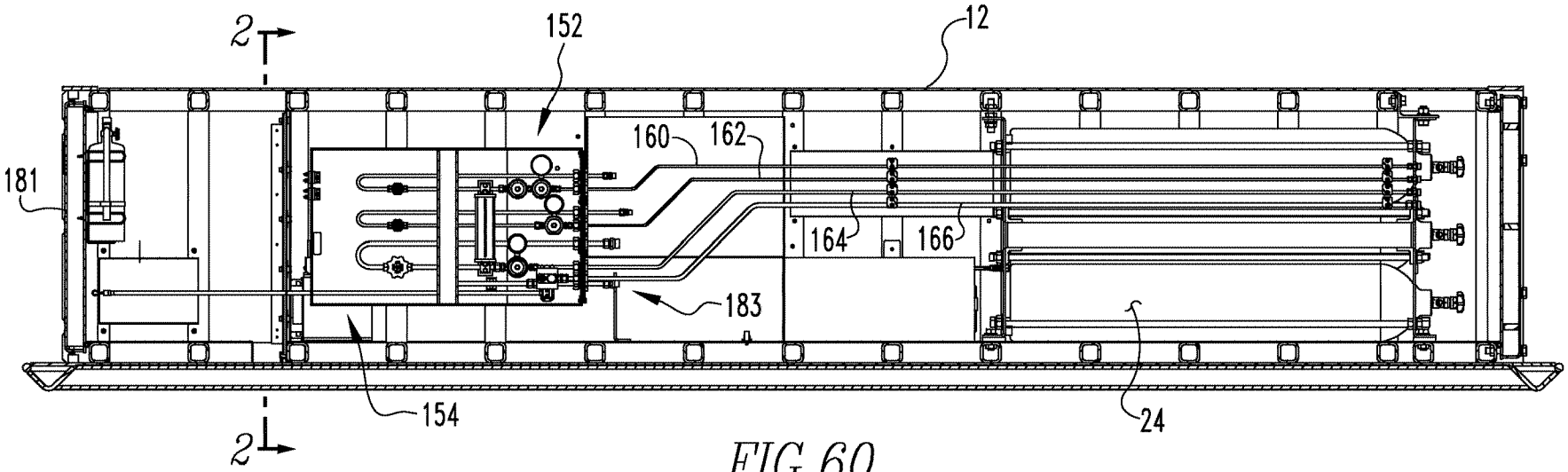
FIG. 60 shows a side cutaway view of the container with the gas bottles and trunks.
Figure 61:
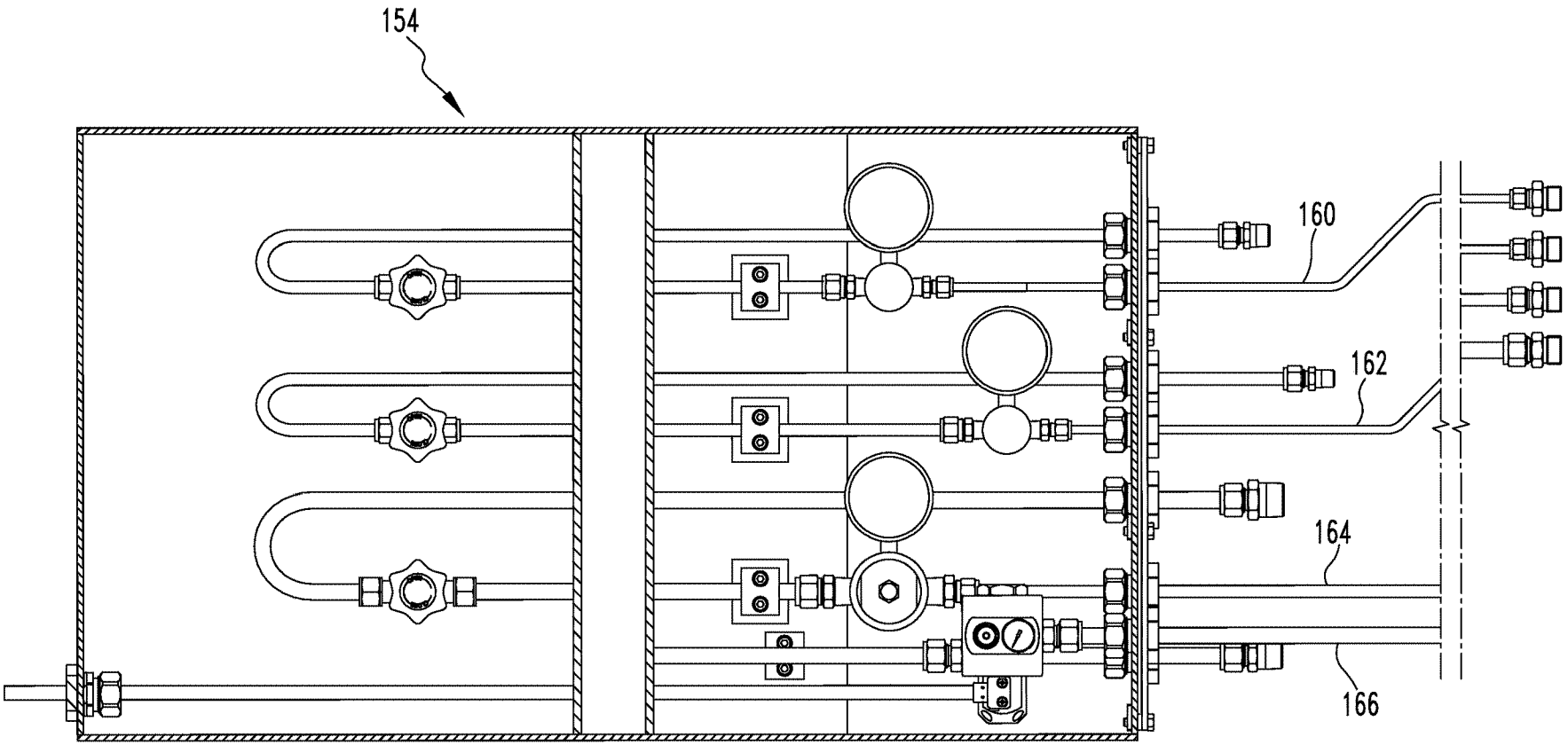
FIG. 61 is a cutaway view of the control cabinet with trunk lines.

FIG. 58 shows a barbed repair coupler 123 for repair purposes that is stored in a repair kit in the container 12. If necessary, if there is a leak in a fireman hose 56, the portion of the fireman hose 56 with a leak can be cut out and the repair coupler 123 can be placed between the separated pieces of the fireman hose 56 with clamps 64 to link them back together to repair the leak.

FIG. 42 shows the backing bar 72, long 114, with respect to the tent adapter frame 71. FIG. 44 shows the backing bar 72, short 112, of the tent adapter frame 71. FIG. 43 shows the tent adapter frame 71.

Figure 62:
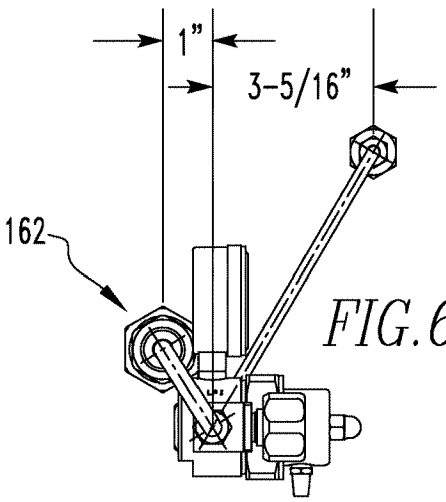
FIG. 62 is an axial view of the fan drive trunk.
Figure 64:
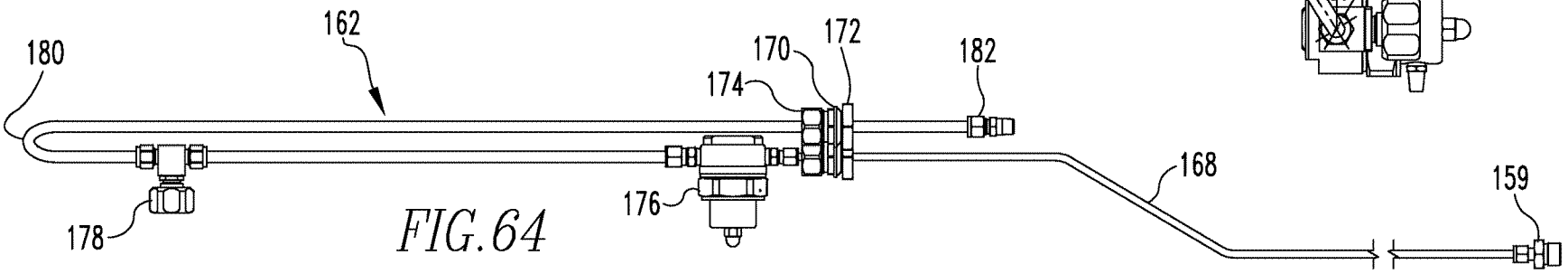
FIG. 64 is a side view of the fan drive trunk.
Figure 63:
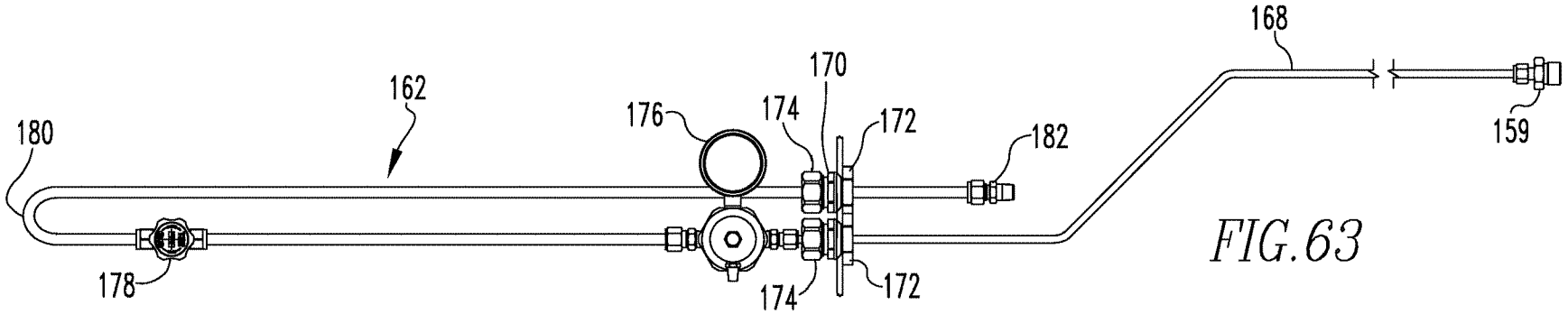
FIG. 63 is an overhead view of the fan drive trunk.

FIGS. 59, 60, 76 and 61 show the primary gas system trunks. For each zone that is to be filled with air and/or oxygen, there is a separate and distinct pressurized trunk line 168 that extends from the pressurized gas bottles 24 in the container 12 ultimately to the zone to be filled with air. There is the oxygen trunk 160, the fan drive trunk 162, the purge trunk 164 and the inflate trunk 166. FIGS. 62, 63 and 64 show the fan drive trunk 162 line 168 assembly that fills the tent 14 and runs the air driven scrubber 106 and provides continuous air and oxygen to the inhabitants in the shelter 10. The air and oxygen that fills the tent 14 passes through the scrubber 106. The oxygen and air bottles 24 are connected to this line 168 when the container 12 is first filled and closed off. The pressurized gas from the bottles 24 is held in place by a regulator gauge assembly 152. The regulator gauge assembly 152 is located in a control cabinet 154 that provides controllability to the line 168.

Figures 65, 66, 67:
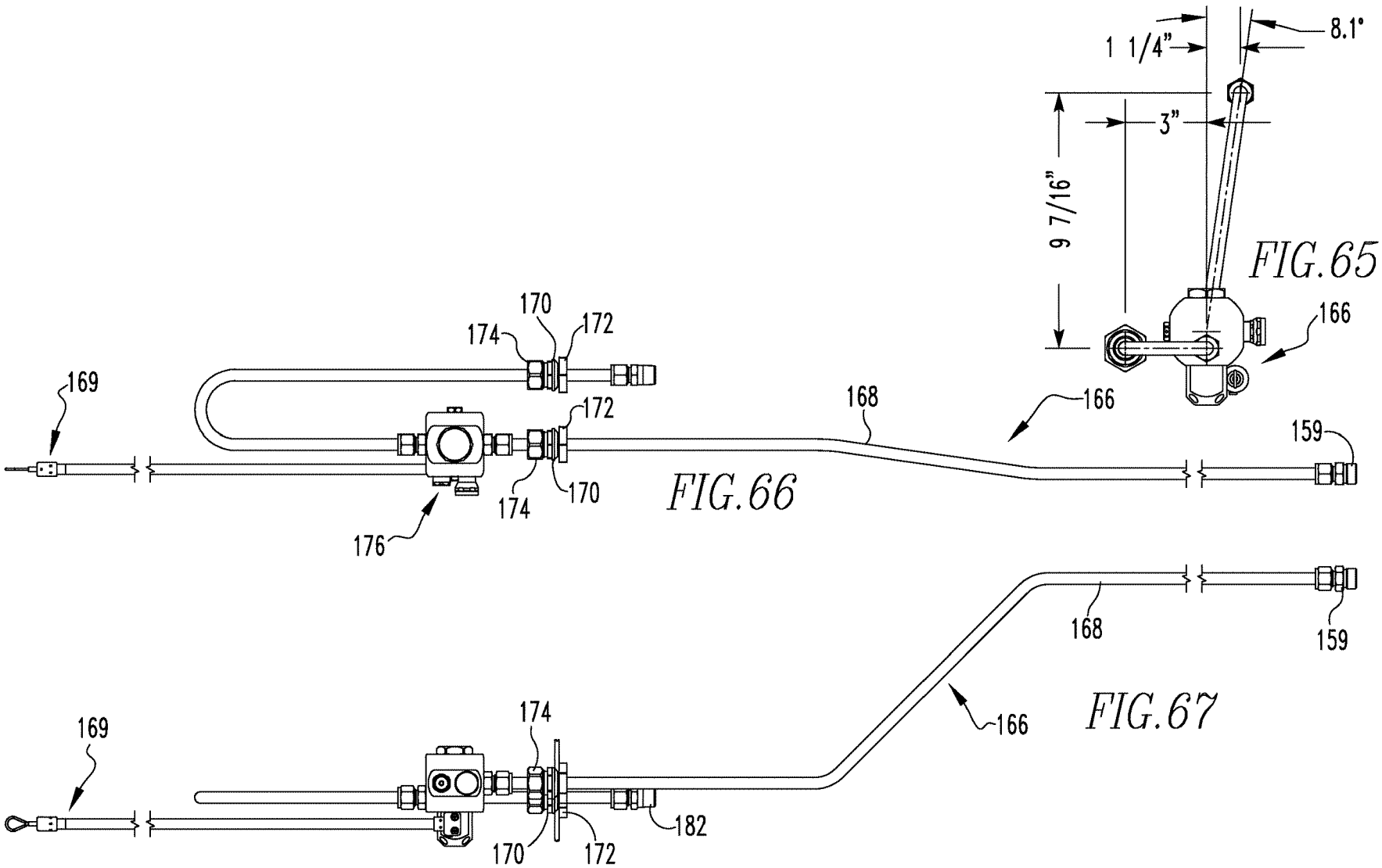
FIG. 65 is an axial view of the inflate trunk.
FIG. 66 is an overhead view of the inflate trunk.
FIG. 67 is a side view of the inflate trunk.
Figure 76:
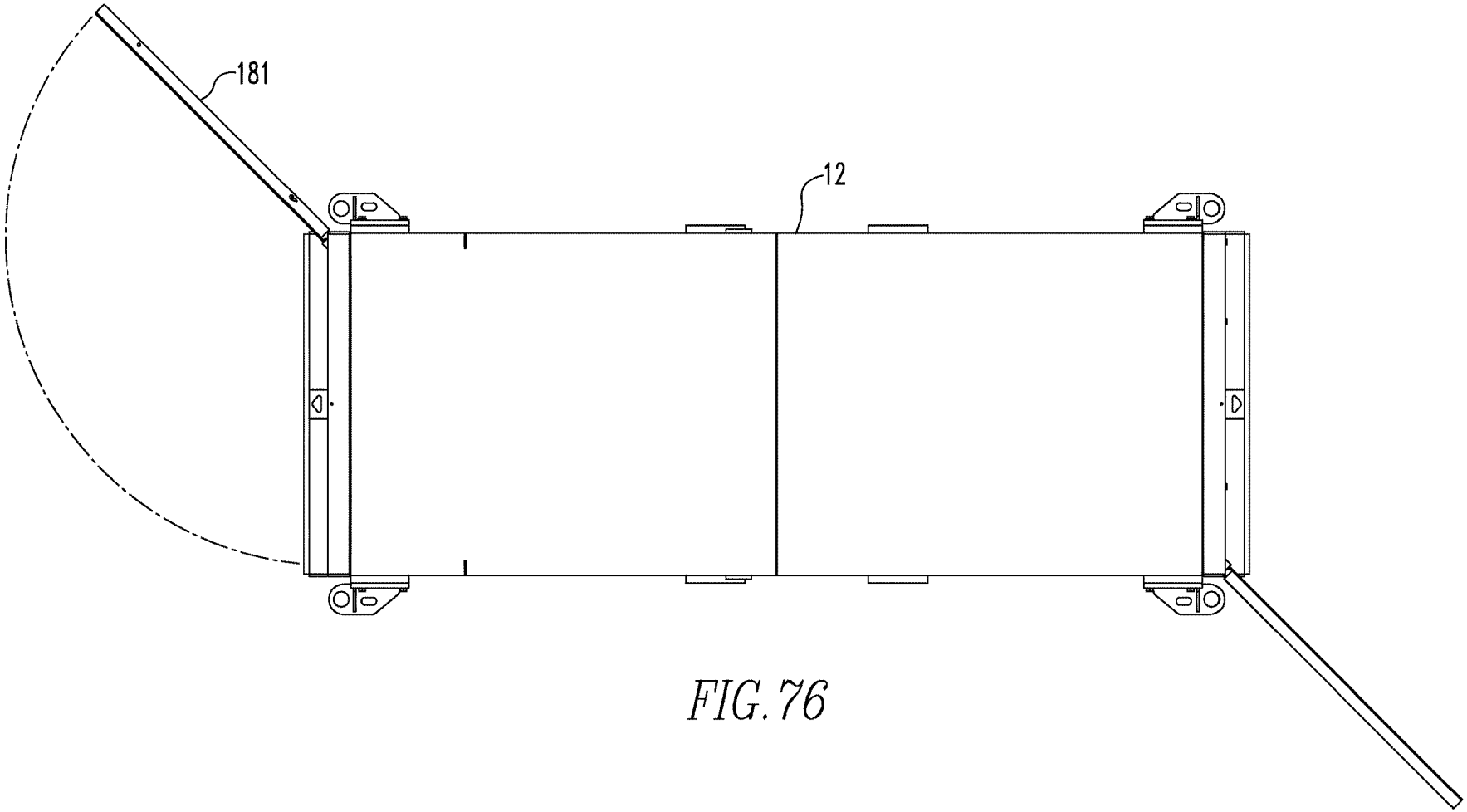
FIG. 76 shows the container with its doors open.

The gas line 168 or tube connected to a pressurized bottle 24 with a bottle fitting 159 passes through a gasket 170 between a locknut 172 and a cord grip 174 in the wall of the cabinet 154 to the regulator 176 and then to a valve 178 that can be used to control the flow through the line 168. The line 168 then has a bend 180 and the line 168 returns and extends back through the wall of the cabinet 154. At the end of the tube is a fitting 182 that connects to the hose that extends to the scrubber 106. In this case, oxygen is also provided along its own line 168 to the scrubber 106 and the amount of oxygen can be determined by a valve 178 based on the number of inhabitants in the shelter 10. When the shelter 10 needs to be deployed, the door 181 of the container 12 is opened, as shown in FIG. 76, and the tent 14 inside the container 12 is rolled out. Next, a cord 169, as shown in FIGS. 66 and 67, on the outside wall of the container 12 is pulled to activate the regulator 176 of the inflate trunk 166 and allow the pressurized gas from the bottles 24 to pass and fill airlock 28 through the airlock hose 92, the support structure 16 through the inflation hose 91, and the main tent chamber 26 through the manifold 183 in regard to its main chamber port 185. The other trunks are manually activated by a miner opening each of their respective valves 178, which are accessed by opening the control cabinet 154. This is typically done when the shelter 10 in the undeployed state is first placed inside the mine so the fan, oxygen and purge lines are all activated waiting for deployment of the shelter 10. In regard to the purge trunk 164, the purge trunk 164 line 168 to the purge valve 100 through the purge hose 96 once activated, it is only when a miner enters the airlock 28 and manually opens the purge valve 100 is pressurized gas released from the purge valve 100 into the airlock 28. In regard to the oxygen trunk 160 line 168 and the fan drive 162 line 168, they both connect with a flow valve on the scrubber 106. The flow valve on the scrubber is maintained in an off position so although the oxygen and fan drive trunk lines 168 are activated, no oxygen or air will escape. Once the shelter 10 is deployed however, the miners after they enter the main tent chamber 26, will pull the scrubber 106 from the container 12 with the oxygen and fan drive trunk lines attached into the main tent chamber 26. Once the scrubber 106 is in place, the scrubber flow valve is opened to allow flow of air and oxygen to the scrubber 106. The flow valve can be set to vary the level of oxygen flow from the oxygen trunk 160 line 168 based on the number of miners in the shelter 10. It should be noted that the container 12 in its undeployed state is of a size that makes it available to be moved, for instance with a forklift, inside the mine to desired locations. As the face of the shaft in a mine moves through the earth as the coal is removed, the container 12 can be moved to follow the progression of the shaft.

Figure 68:
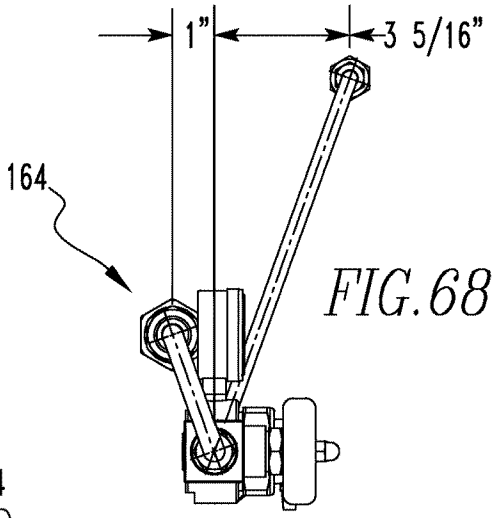
FIG. 68 is an axial view of the purge trunk.
Figure 69:
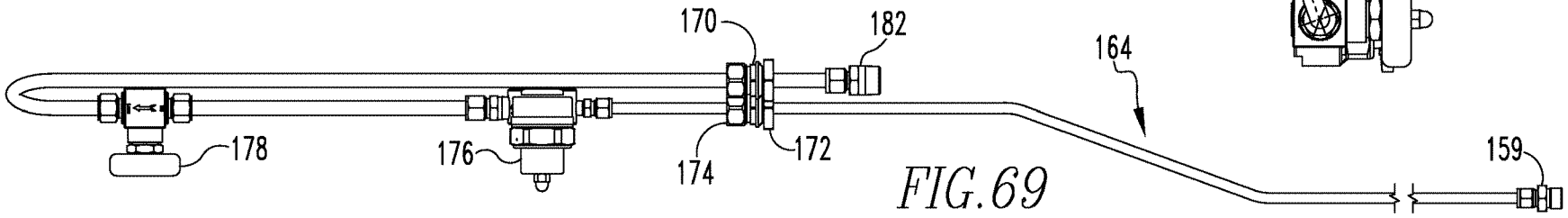
FIG. 69 is a side view of the purge trunk.
Figure 70:
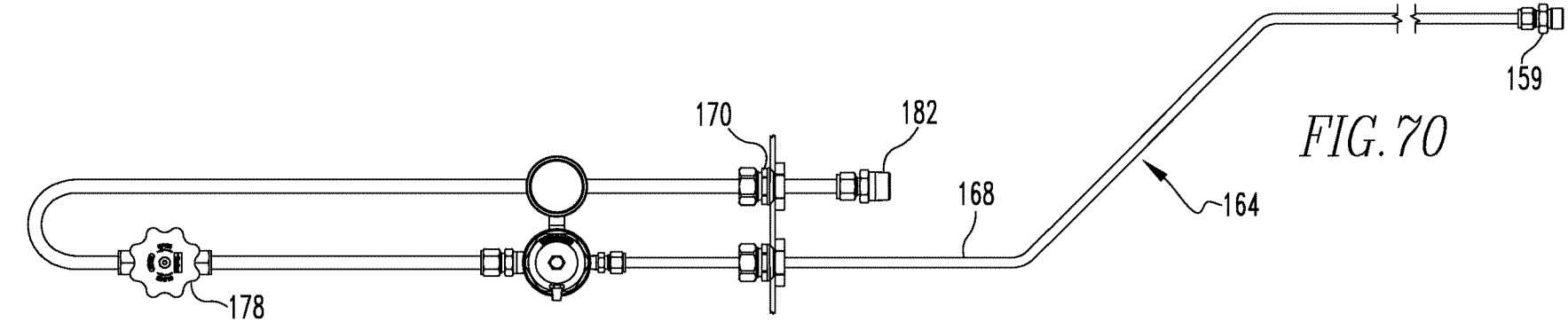
FIG. 70 is an overhead view of the purge trunk.
Figure 71:
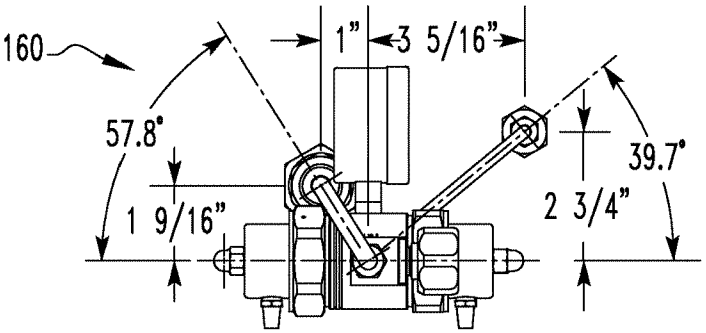
FIG. 71 is an axial view of the oxygen trunk.
Figure 72:
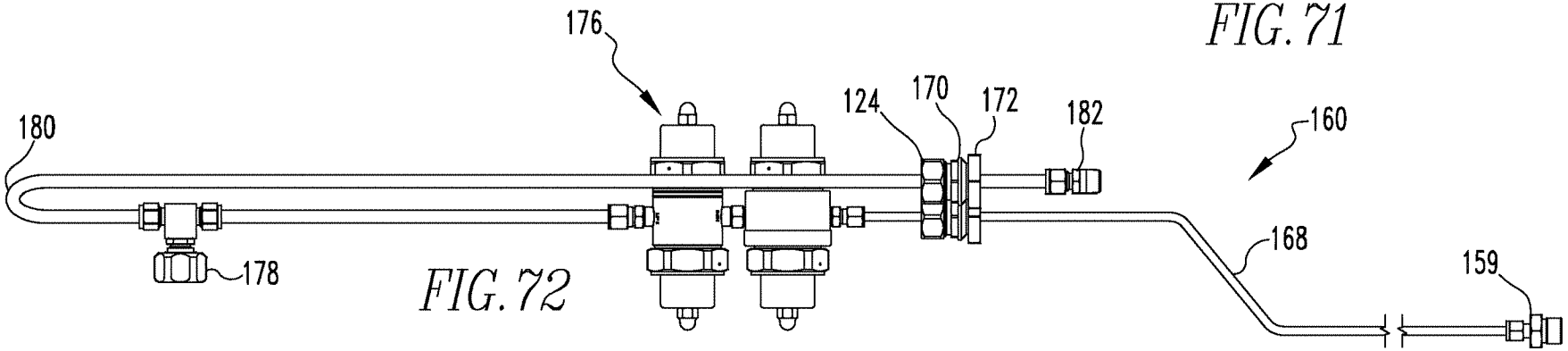
FIG. 72 is a side view of the oxygen trunk.
Figure 73:
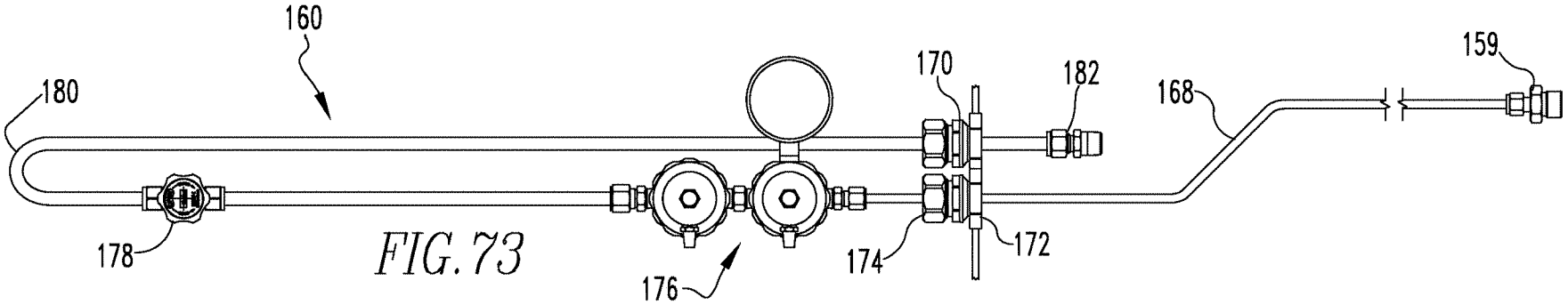
FIG. 73 is an overhead view of the oxygen trunk.
Figure 74:
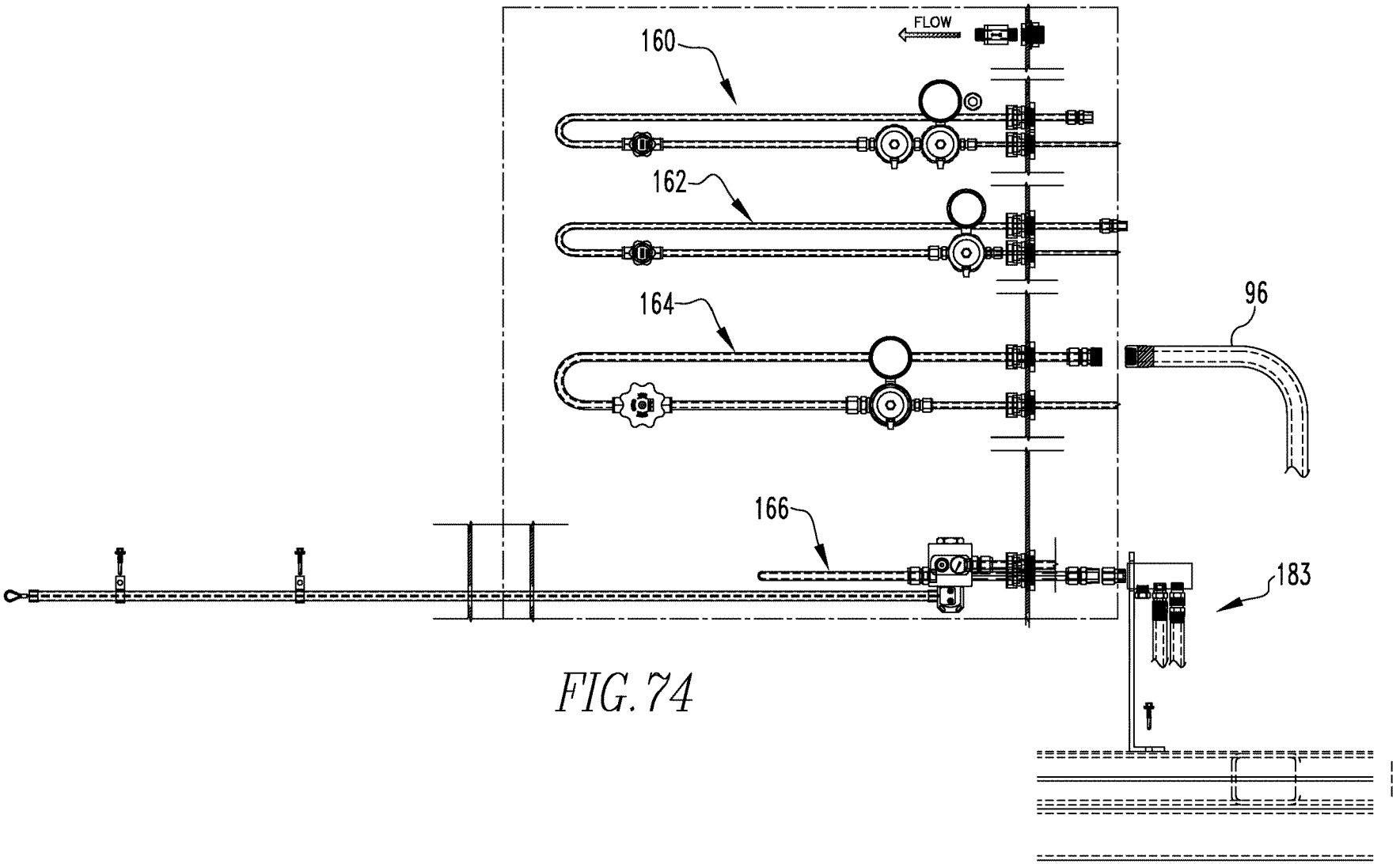
FIG. 74 is a side view of the trunks and manifold.
Figure 75:
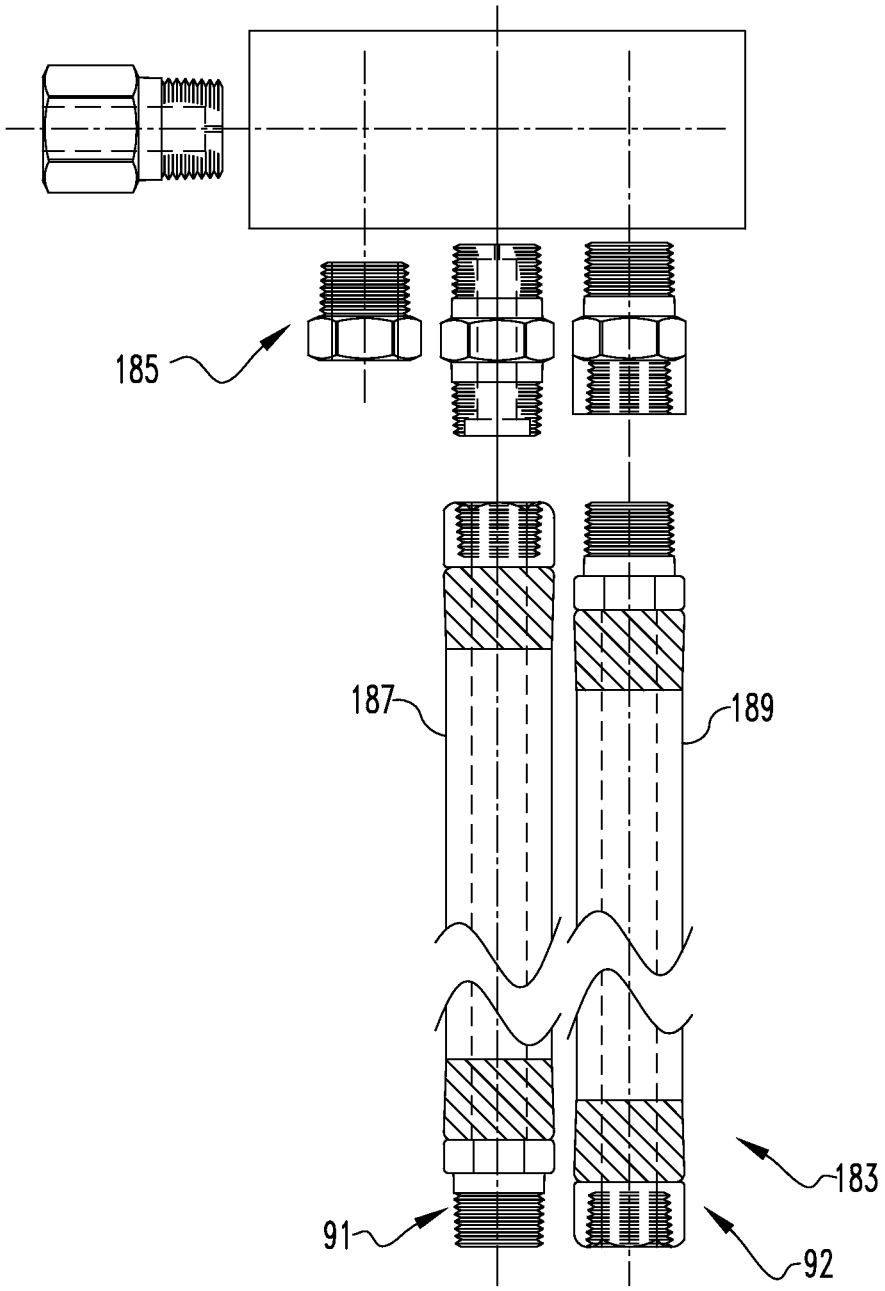
FIG. 75 shows the manifold.

All of the different trunk lines operate essentially in the same way. FIGS. 68, 69 and 70 show the purge trunk 164 line 168 assembly. The purge trunk 164 line 168 assembly operates and has the same architecture essentially as that described above for the fan drive trunk 162 line 168 assembly. A bottle fitting 159 at the start of the line 168 or tube is connected to the pressurized gas bottles 24 dedicated for this trunk line 164. The line 168 or tube passes through the cabinet 154 wall by way of a gasket 170, to a regulator 176, past a valve 178 and then back out of the cabinet 154 wall, where it has a fitting 182 to connect with the purge hose 96. Similarly, FIGS. 65, 66 and 67 show the inflate trunk 166 line 168 assembly that inflates the fireman hose 56 support structure 16. The inflate trunk 166 line 168 assembly connects with a manifold 183, shown in FIGS. 74 and 75, disposed in the container 12. The manifold 183 has an inflate hose extension 187 that connects to the inflation hose 91 extending from it to connect with the fireman hose 56 support structure 16 to inflate the fireman hose 56 support structure 16, and a lock hose extension 189 that connects to the air lock hose 92 so some of the air from the inflate trunk 166 line 168 assembly inflates the air lock 28. In addition, there is a main chamber port 185 in the manifold 183 that also releases air directly from the manifold into the main tent chamber 26 to also fill the main tent chamber 26 along with air and oxygen from the scrubber 106. FIGS. 71, 72 and 73 show the oxygen trunk 166 line 168.

Per 30 CFR § 7.505, the deployed refuge shelter 10 provides at least 15 square feet of floor space per person and 30 to 60 cubic feet of volume per person according to the following chart. The airlock is included in the space and volume since waste is disposed outside the refuge alternative.

| unrestricted volume (cubic Mining height (inches) feet) per person * | |
|---|---|
| 36 or less | 30 |
| >36-<=42 | 37.5 |
| >42-<=48 | 5 |
| >48-<=54 | 52.5 |
| >54 | 60 |

* Includes an adjustment of 12 inches for clearances.

The supplies can include a self-rescuer system, as described in U.S. patent application Ser. No. 14/242,362, incorporated by reference herein.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. A refuge shelter for miners in a mine to protect the miners from the external environment, the shelter comprising:

a container; and a tent that is disposed in the container in an undeployed state which is expandable to a deployed state and extends from the container to provide a protected atmosphere for the miners, the container accessible from inside the tent, the tent having a test port having a gasket in the tent's wall to which a sample of the external environment can be obtained from inside the tent.

* * * * *